US011415005B2

(12) United States Patent
Whittle et al.

(10) Patent No.: US 11,415,005 B2
(45) Date of Patent: Aug. 16, 2022

(54) TURBINE VANE ASSEMBLY INCORPORATING CERAMIC MATRIX COMPOSITE MATERIALS

(71) Applicant: Rolls-Royce plc, London (GB)

(72) Inventors: Michael J. Whittle, London (GB); Keith Sadler, London (GB)

(73) Assignee: Rolls-Royce plc

( * ) Notice: Subject to any disclaimer, the term of this patent is extended or adjusted under 35 U.S.C. 154(b) by 69 days.

(21) Appl. No.: 17/065,948

(22) Filed: Oct. 8, 2020

(65) Prior Publication Data

US 2021/0108524 A1 Apr. 15, 2021

Related U.S. Application Data

(60) Provisional application No. 62/912,950, filed on Oct. 9, 2019.

(51) Int. Cl.

| | |
|---|---|
| ***F01D 9/04*** | (2006.01) |
| ***F01D 9/00*** | (2006.01) |
| ***F01D 25/00*** | (2006.01) |
| *F01D 5/28* | (2006.01) |

(52) U.S. Cl.

CPC ..... *F01D 9/00* (2013.01); *F01D 9/041* (2013.01); *F01D 25/005* (2013.01); *F01D 5/282* (2013.01); *F01D 5/284* (2013.01); *F05D 2240/12* (2013.01)

(58) Field of Classification Search

CPC ... F01D 9/00; F01D 9/041; F01D 9/04; F01D 25/005

See application file for complete search history.

(56) References Cited

U.S. PATENT DOCUMENTS

| | | | | |
|---|---|---|---|---|
| 3,302,926 | A | 2/1967 | Bobo | |
| 4,126,405 | A | 11/1978 | Bobo et al. | |
| 5,269,651 | A | 12/1993 | Ostermeir et al. | |
| 6,290,459 | B1 | 9/2001 | Correia | |
| 7,101,150 | B2 | 9/2006 | Bash et al. | |
| 7,185,433 | B2 * | 3/2007 | Miller | F01D 5/005 29/889.22 |
| 7,452,189 | B2 | 11/2008 | Shi et al. | |
| 7,824,152 | B2 | 11/2010 | Morrison | |
| 8,128,354 | B2 | 3/2012 | Hansen et al. | |
| 8,371,812 | B2 | 2/2013 | Manteiga et al. | |
| 8,454,303 | B2 | 6/2013 | Garcia-Crespo | |
| 8,511,982 | B2 | 8/2013 | Hart et al. | |
| 8,668,440 | B2 | 3/2014 | Bulter et al. | |

(Continued)

FOREIGN PATENT DOCUMENTS

| | | |
|---|---|---|
| EP | 3034802 A1 | 6/2016 |
| EP | 3121379 A1 | 1/2017 |
| WO | 2011047693 | 4/2011 |

OTHER PUBLICATIONS

Extended European Search Report, European Application No. 20200585.6-1004, dated Feb. 18, 2021, 7 pages.

*Primary Examiner* — Michael L Sehn

(74) *Attorney, Agent, or Firm* — Barnes & Thornburg LLP

(57) ABSTRACT

A turbine vane assembly adapted for use in a gas turbine engine includes a plurality of turbine vanes, an outer vane support, and an inner vane support. The plurality of turbine vanes comprise ceramic matrix composite material and are adapted to interact with hot gases flowing through a gas path of the gas turbine engine during use of the turbine vane assembly.

16 Claims, 15 Drawing Sheets

(56) References Cited

U.S. PATENT DOCUMENTS

| | | | | |
|---|---|---|---|---|
| 9,816,387 | B2 | 11/2017 | Carr et al. | |
| 9,863,260 | B2 * | 1/2018 | Weaver | F01D 9/042 |
| 9,915,159 | B2 * | 3/2018 | Huizenga | F01D 25/162 |
| 9,915,170 | B2 | 3/2018 | Winn et al. | |
| 10,030,538 | B2 | 7/2018 | Hernandez et al. | |
| 10,161,257 | B2 | 12/2018 | Huizenga et al. | |
| 10,190,426 | B2 | 1/2019 | Fremont | |
| 10,309,240 | B2 | 6/2019 | Heitman et al. | |
| 10,337,340 | B2 | 7/2019 | Cortequisse | |
| 2002/0187040 | A1 | 12/2002 | Predmore | |
| 2004/0120811 | A1 | 6/2004 | Darkins et al. | |
| 2010/0068034 | A1 | 3/2010 | Schiavo et al. | |
| 2014/0161623 | A1 | 6/2014 | Zurmehly et al. | |
| 2014/0255174 | A1 | 9/2014 | Duelm et al. | |
| 2015/0093249 | A1 | 4/2015 | Lang et al. | |
| 2016/0177761 | A1 | 6/2016 | Huizenga et al. | |
| 2016/0230576 | A1 * | 8/2016 | Freeman | F04D 29/542 |
| 2016/0290147 | A1 | 10/2016 | Weaver | |
| 2016/0312658 | A1 | 10/2016 | Heitman et al. | |
| 2017/0022833 | A1 | 1/2017 | Heitman et al. | |
| 2017/0051619 | A1 | 2/2017 | Tuertscher | |
| 2018/0223680 | A1 | 8/2018 | Hafner | |
| 2020/0024972 | A1 | 1/2020 | Freeman et al. | |
| 2020/0200024 | A1 | 6/2020 | Whittle | |
| 2020/0340365 | A1 | 10/2020 | Whittle et al. | |
| 2020/0362707 | A1 | 11/2020 | Whittle et al. | |
| 2021/0025282 | A1 | 1/2021 | Wong et al. | |

* cited by examiner

TURBINE VANE ASSEMBLY INCORPORATING CERAMIC MATRIX COMPOSITE MATERIALS

CROSS REFERENCE TO RELATED APPLICATIONS

This application claims priority to and the benefit of U.S. Provisional Patent Application No. 62/912,950, filed 9 Oct. 2019, the disclosure of which is now expressly incorporated herein by reference.

FIELD OF THE DISCLOSURE

The present disclosure relates generally to gas turbine engines, and more specifically to turbine vane assemblies for use with gas turbine engines.

BACKGROUND

Gas turbine engines are used to power aircraft, watercraft, power generators, and the like. Gas turbine engines typically include a compressor, a combustor, and a turbine. The compressor compresses air drawn into the engine and delivers high pressure air to the combustor. In the combustor, fuel is mixed with the high pressure air and is ignited. Products of the combustion reaction in the combustor are directed into the turbine where work is extracted to drive the compressor and, sometimes, an output shaft. Left-over products of the combustion are exhausted out of the turbine and may provide thrust in some applications.

Products of the combustion reaction directed into the turbine are conducted toward airfoils included in stationary vanes and rotating blades of the turbine. The airfoils are often made from high-temperature resistant materials and/or are actively cooled by supplying relatively cool air to the vanes and blades due to the high temperatures of the combustion products. To this end, some airfoils for vanes and blades are incorporating composite materials adapted to withstand very high temperatures. Design and manufacture of vanes and blades from composite materials presents challenges because of the geometry and strength desired for the parts.

SUMMARY

The present disclosure may comprise one or more of the following features and combinations thereof.

A turbine vane assembly for use in a gas turbine engine may include a plurality of ceramic matrix composite turbine vanes and a metallic outer vane support. The plurality of ceramic matrix composite turbine vanes may be adapted to interact with hot gases flowing through a gas path of the gas turbine engine during use of the turbine vane assembly. The metallic outer vane support may be configured to receive force loads applied to the plurality of ceramic matrix composite turbine vanes by the hot gases during use of the turbine vane assembly in the gas turbine engine.

In some embodiments, the plurality of ceramic matrix composite turbine vanes may include a first turbine vane and a second turbine vane. The second turbine vane may be spaced apart circumferentially from the first turbine vane relative to an axis.

In some embodiments, the metallic outer vane support may include an outer mount, a first support spar, and a second support spar. The outer mount may be located radially outward of the plurality of ceramic matrix composite turbine vanes and may extend at least partway circumferentially about the axis. The second support spar may be spaced apart circumferentially from the first support spar relative to the axis.

In some embodiments, the first support spar may extend radially inward from the outer mount through an interior cavity of the first turbine vane. The second support spar may extend radially inward from the outer mount through an interior cavity of the second turbine vane. In some embodiments, the first and second support spars are integrally formed with the outer mount to form a single-piece component.

In some embodiments, the turbine vane assembly may include a metallic inner vane support. The inner vane support may be spaced apart radially from the outer mount relative to the axis to locate the plurality of turbine vanes radially between.

In some embodiments, the metallic inner vane support may include an inner mount and at least two fasteners. The inner mount may extend at least partway circumferentially about the axis. The at least two fasteners may be configured to couple the first and second support spars of the metallic outer vane support to the inner mount to provide a mechanical linkage between the first turbine vane and the second turbine vane. In some embodiments, the mechanical linkage formed between the outer vane support and the inner vane support may reduce twisting of the turbine vane assembly and adjacent turbine vane assemblies relative to one another during use of the turbine vane assembly in the gas turbine engine.

In some embodiments, the inner mount may include an inner mount platform and raised interface surfaces. The inner mount platform may extend at least circumferentially partway about the axis between the plurality of ceramic matrix composite turbine vanes. The raised interface surfaces may be spaced circumferentially apart from one another. In some embodiments, each of the raise interface surfaces may extend radially outward from the inner mount platform and engage one of the first support spar and the second support spar to block radial movement of the inner mount relative to the outer vane support.

In some embodiments, the inner mount may further include anti-rotation pegs. The anti-rotation pegs may each extend radially outward from one of the raised interface surfaces and into a corresponding support spar to block twisting of the inner mount relative to the outer vane support.

In some embodiments, the metallic inner vane support may further include a first nozzle and a second nozzle. The first nozzle may be arranged radially inward from the inner mount platform and configured to receive an inner end of the first support spar. The second nozzle may be arranged radially inward from the inner mount platform and configured to receive an inner end of the second support spar.

In some embodiments, the inner end of each of the first and second support spars may be threaded and the at least two fasteners may be nuts. The nuts may be configured to mate with threads on the inner end of one of the first and second support spars and engage one of the first nozzle and the second nozzle to maintain engagement of the raised interface surfaces and the anti-rotation pegs with the corresponding support spar of the first support spar and the second support spar.

In some embodiments, the inner mount, the first nozzle, and the second nozzle of the inner vane support may be integrally formed. The inner mount, the first nozzle, and the second nozzle of the inner vane support may be integrally formed such that the inner mount, the first nozzle, and the second nozzle are a one-piece, integral component.

In some embodiments, the first nozzle and the second nozzle may each include a cylindrical tube, an anti-rotation notch, and a spout. The cylindrical tube may be configured to receive the inner end of one of the first support spar and the second support spar. The anti-rotation notch may extend into the cylindrical tube and may be configured to receive an anti-rotation tab extending radially inward from the inner mount platform. The spout may extend circumferentially from the cylindrical tube and may be configured to discharge a flow of cooling air.

In some embodiments, the inner end of each of the first and second support spars may be threaded and the at least two fasteners each include a first nut and a second nut. Each of the first nuts may be configured to mate with threads on the inner end of one of the first and second support spars and engage the inner mount platform to maintain engagement of the raised interface surfaces and the anti-rotation pegs with the corresponding support spar of the first support spar and the second support spar. Each of the second nuts may be spaced radially inward of the first nut to locate one of the first nozzle and the second nozzle therebetween.

In some embodiments, each of the second nuts may be configured to mate threads on the inner end of one of the first support spar and the second support spar. The second nuts may be configured to engage one of the first nozzle and the second nozzle to block removal of the one of the first nozzle and the second nozzle off the inner end of the one of the first support spar and the second support spar.

In some embodiments, the inner vane support may further include a first nozzle and a second nozzle. The first nozzle may be arranged radially inward from the inner mount platform and may be configured to receive an inner end of the first support spar. The second nozzle may be arranged radially inward from the inner mount platform and may be configured to receive an inner end of the second support spar.

In some embodiments, the at least two fasteners may include plurality of bolts. The plurality of bolts may each extend through one of the first nozzle and the second nozzle and the inner mount platform into one of the first support spar and the second support spar. The plurality of bolts may be configured to couple each of the first nozzle and the second nozzle to the inner mount platform and block twisting of the inner vane support relative to the outer vane support.

In some embodiments, the metallic outer vane support may include an outer mount platform and a plurality of reinforcement extensions. The outer mount platform may extend circumferentially at least partway about the axis. The outer mount platform may be configured to be coupled to a turbine case of the gas turbine engine. The plurality of reinforcement extensions may extend radially outward from an outer surface of the outer mount platform relative to the axis. The reinforcement extensions may be configured to minimize resulting stresses in the outer mount platform due to the twisting of the turbine vane assembly.

In some embodiments, the plurality of reinforcement extensions may include a plurality of axially extending reinforcement ribs and a plurality of circumferentially extending reinforcement ribs. The axially extending reinforcement ribs may extend radially outward from and axially along the outer surface of the outer mount platform relative to the axis. The circumferentially extending reinforcement ribs may extend radially outward from and circumferentially along the outer surface of the outer mount platform relative to the axis.

In some embodiments, the turbine vane assembly may further comprise a metallic inner vane support spaced apart radially from the outer mount relative to the axis to locate the plurality of ceramic matrix composite turbine vanes radially between. The metallic inner vane support may include an inner mount platform, a first mating feature, and a second mating feature. The inner mount platform may extend at least partway circumferentially about the axis. The first mating feature may engage an inner end of the first support spar to block rotation of the metallic outer vane support about a spar axis relative to the metallic inner vane support. The second mating feature may couple to an inner end of the second support spar to block radial movement of the metallic outer vane support relative to the metallic inner vane support.

In some embodiments, the metallic inner vane support may further include a locking pin. The locking pin may extend through the inner mount platform and into the first support spar to block circumferential rotation of the metallic outer vane support about the axis relative to the metallic inner vane support.

In some embodiments, the first mating feature may be a rotational stop. The rotational stop may extend radially outward from the inner mount and engage the inner end of the first support spar. The rotational stop may provide load transfer from the inner mount platform to the first support spar of the outer vane support.

In some embodiments, the second mating feature may be at least one locking notch formed in the inner mount platform. The second support spar may include at least one locking tab that extends circumferentially from the inner end of the second support spar and into the notch to provide a bayonet fitting therebetween. The bayonet fitting may block radial movement of the outer vane support relative to the inner vane support.

In some embodiments, the turbine vane assembly may further comprise a metallic inner vane support spaced apart radially from the outer mount relative to the axis to locate the plurality of ceramic matrix composite turbine vanes radially between. The metallic inner vane support may include an inner mount and a retainer plate. The inner mount may extend at least partway circumferentially about the axis. The retainer plate may be located radially inward of the inner mount.

In some embodiments, the retainer plate may couple to an inner end of the second support spar to block radial movement of the metallic outer vane support relative to the metallic inner vane support. The retainer plate may engage an inner end of the first support spar to block rotation of the metallic outer vane support about a spar axis relative to the metallic inner vane support.

In some embodiments, the turbine vane assembly may further comprise a metallic inner vane support spaced apart radially from the outer mount relative to the axis to locate the plurality of ceramic matrix composite turbine vanes radially between. The metallic inner vane support may include an inner mount platform and at least one locking notch formed in the inner mount platform. The inner mount platform may extend at least partway circumferentially about the axis. The at least one locking notch may receive at least one locking tab formed on an inner end of the second support spar to block radial movement of the metallic outer vane support relative to the metallic inner vane support.

In some embodiments, the metallic inner vane support may further include a locking pin. The locking pin may extend through the inner mount platform and into the first support spar to block circumferential rotation of the metallic outer vane support about the axis relative to the metallic inner vane support.

In some embodiments, the metallic inner vane support may further include a rotational stop. The rotational stop may engage an inner end of the first support spar to block rotation of the metallic outer vane support about a spar axis relative to the metallic inner vane support.

According to another aspect of the present disclosure, a turbine vane assembly for use in a gas turbine engine may include a plurality of turbine vanes and an outer vane support. In some embodiments, the outer vane support may at least one outer mount and a plurality of support spars.

In some embodiments, the outer mount may be located radially outward of the plurality of ceramic matrix composite turbine vanes and may extend circumferentially at least partway about an axis. The plurality of support spars may each extend radially inward from the at least one outer mount through an interior cavity of one turbine vane of the plurality of turbine vanes. In some embodiments, wherein the plurality of support spars may be integrally formed with the at least one outer mount to form a single-piece component.

In some embodiments, the turbine vane assembly further may include an inner vane support. The inner vane support may be spaced apart radially from the at least one outer mount relative to the axis to locate the plurality of turbine vanes radially between.

In some embodiments, the inner vane support may include at least one inner mount and a plurality of fasteners. The at least one inner mount may extend circumferentially at least partway about the axis. The plurality of fasteners may each be configured to couple a corresponding support spar of the plurality of support spars of the outer vane support to the at least one inner mount.

In some embodiments, the plurality of turbine vanes may include at least two turbine vanes. In some embodiments, the plurality of support spars may include at least two support spars.

In some embodiments, the plurality of turbine vanes may include at least three turbine vanes. In some embodiments, the plurality of support spars may include at least three support spars.

In some embodiments, the outer vane support may include at least two outer mounts. The at least two outer vane mounts may have a second outer mount spaced apart circumferentially from a first outer mount.

In some embodiments, the plurality of support spars includes a first support spar, a second support spar, a third support spar, and a fourth support spar. The first support spar may extend radially inward from the first outer mount through a first turbine vane of the plurality of turbine vanes. The second support spar may be spaced apart circumferentially from the first support spar relative to the axis and may extend radially inward from the first outer mount through a second turbine vane of the plurality of turbine vanes. The third support spar may extend radially inward from the second outer mount through a third turbine vane of the plurality of turbine vanes. The fourth support spar may be spaced apart circumferentially from the third support spar relative to the axis and may extend radially inward from the second outer mount through a fourth turbine vane of the plurality of turbine vanes.

In some embodiments, the first outer mount and the second outer mount may each include an outer mount platform and a plurality of reinforcement extensions. Each outer mount platform may extend at least partway about the axis and may be configured to be coupled to a turbine case. The plurality of reinforcement extensions may extend radially outward from an outer surface of the outer mount platform relative to the axis.

In some embodiments, the at least one inner mount may include an inner mount platform raising interface surfaces, and anti-rotation pegs. The inner mount platform may extend at least circumferentially partway about the axis between the plurality of turbine vanes. The raised interface surfaces may be spaced circumferentially apart from one another and each extend radially outward from the inner mount platform. The anti-rotation pegs may each extend radially outward from one of the raised interface surfaces.

In some embodiments, the raised interface surfaces may engage one of the plurality of support spars to block radial movement of the at least one inner mount relative to the outer vane support. The anti-rotation pegs may each extend radially outward into one support spar of the plurality of support spars to block twisting of the at least one inner mount relative to the outer vane support.

In some embodiments, the inner vane support may include at least two inner mounts. The at least two inner mounts may have a second inner mount spaced apart circumferentially from a first inner mount.

In some embodiments, the plurality of fasteners may include a first fastener, a second fastener, a third fastener, and a fourth fastener. The first fastener may be configured to couple a first support spar of the plurality of support spars to the first inner mount. The second fastener may be configured to couple a second support spar of the plurality of support spars to the first inner mount. The third fastener may be configured to couple a third support spar of the plurality of support spars to the second inner mount. The fourth fastener may be configured to couple a fourth support spar of the plurality of support spars to the second inner mount.

In some embodiments, the first inner mount and the second inner mount may each include an inner mount platform raised interface surfaces, and anti-rotation pegs. The inner mount platform may extend at least circumferentially partway about the axis between at least two turbine vanes of the plurality of turbine vanes. The raised interface surfaces may be spaced circumferentially apart from one another and each extend radially outward from the inner mount platform. Each of the raised interface surfaces may engage one of the plurality of support spars to block radial movement of the at least two inner mounts relative to the outer vane support. The anti-rotation pegs may each extend radially outward from one of the raised interface surfaces and into one support spar of the plurality of support spars.

In some embodiments, the inner vane support may further include a plurality of nozzles. Each nozzle of the plurality of nozzles may be configured to receive an inner end of one support spar of the plurality of support spars.

In some embodiments, the turbine vane assembly may further comprise an inner vane support spaced apart radially from an outer mount included in the outer vane support relative to the axis to locate the plurality of turbine vanes radially between. The inner vane support may include an inner mount platform, a first mating feature, and a second mating feature. The inner mount platform may extend at least partway circumferentially about the axis. The first mating feature may engage an inner end of a first support spar included in the plurality of support spars to block rotation of the outer vane support about a spar axis relative to the metallic inner vane support. The second mating feature may couple to an inner end of a second support spar included in the plurality of support spars to block radial movement of the outer vane support relative to the inner vane support.

In some embodiments, the inner vane support may further include a locking pin. The locking pin may extend through the inner mount platform and into the first support spar to block circumferential rotation of the outer vane support about the axis relative to the inner vane support.

In some embodiments, the first mating feature may be a rotational stop. The rotational stop may extend radially outward from the inner mount and engage the inner end of the first support spar. The rotational stop may provide load transfer from the inner mount platform to the first support spar of the outer vane support.

In some embodiments, the second mating feature may be at least one locking notch formed in the inner mount platform. The second support spar may include at least one locking tab that extends circumferentially from the inner end of the second support spar and into the notch to provide a bayonet fitting therebetween. The bayonet fitting may block radial movement of the outer vane support relative to the inner vane support.

In some embodiments, the turbine vane assembly may further comprise an inner vane support spaced apart radially from an outer mount included in the outer vane support relative to the axis to locate the plurality of turbine vanes radially between. The inner vane support may include an inner mount and a retainer plate. The inner mount may extend at least partway circumferentially about the axis. The retainer plate may be located radially inward of the inner mount.

In some embodiments, the retainer plate may couple to an inner end of a first support spar included in the plurality of support spars to block radial movement of the outer vane support relative to the inner vane support. The retainer plate may engage an inner end of a second support spar included in the plurality of support spars to block rotation of the outer vane support about a spar axis relative to the inner vane support.

In some embodiments, the turbine vane assembly may further comprise an inner vane support spaced apart radially from an outer mount included in the outer vane support relative to the axis to locate the plurality of turbine vanes radially between. The inner vane support may include an inner mount platform and a locking pin. The inner mount platform may extend at least partway circumferentially about the axis. The locking pin may extend through the inner mount platform and into a first support spar included in the plurality of support spars to block circumferential rotation of the outer vane support about the axis relative to the inner vane support.

In some embodiments, the inner vane support may further include at least one locking notch formed in the inner mount platform. The at least one locking notch may receive at least one locking tab formed on an inner end of a second support spar included in the plurality of support spars to block radial movement of the outer vane support relative to the inner vane support.

In some embodiments, the metallic inner vane support may further include a rotational stop. The rotational stop may engage an inner end of the first support spar to block rotation of the outer vane support about a spar axis relative to the inner vane support.

These and other features of the present disclosure will become more apparent from the following description of the illustrative embodiments.

DETAILED DESCRIPTION OF THE DRAWINGS

Figure 1:
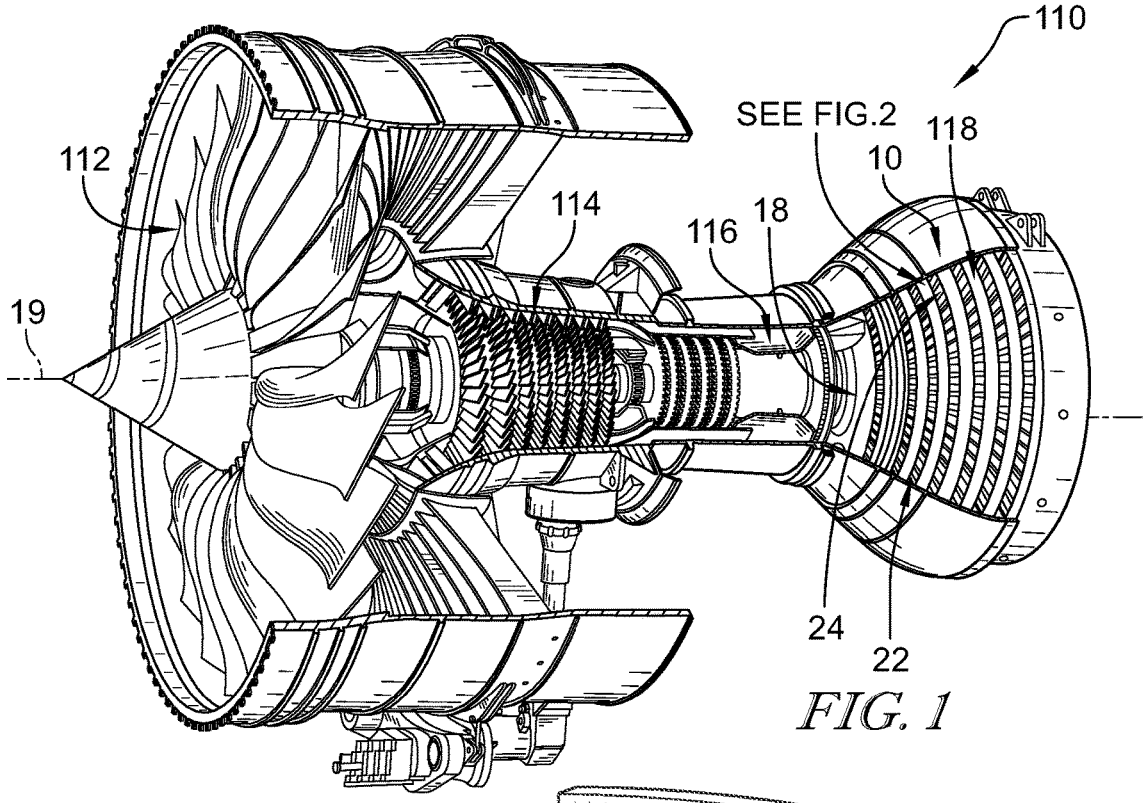
FIG. 1 is a cutaway view of a gas turbine engine that includes a fan, a compressor, a combustor, and a turbine, the turbine including rotating wheel assemblies configured to rotate about an axis of the engine and static turbine vane rings configured to direct air into downstream rotating wheel assemblies.

For the purposes of promoting an understanding of the principles of the disclosure, reference will now be made to a number of illustrative embodiments illustrated in the drawings and specific language will be used to describe the same.

Figure 2:
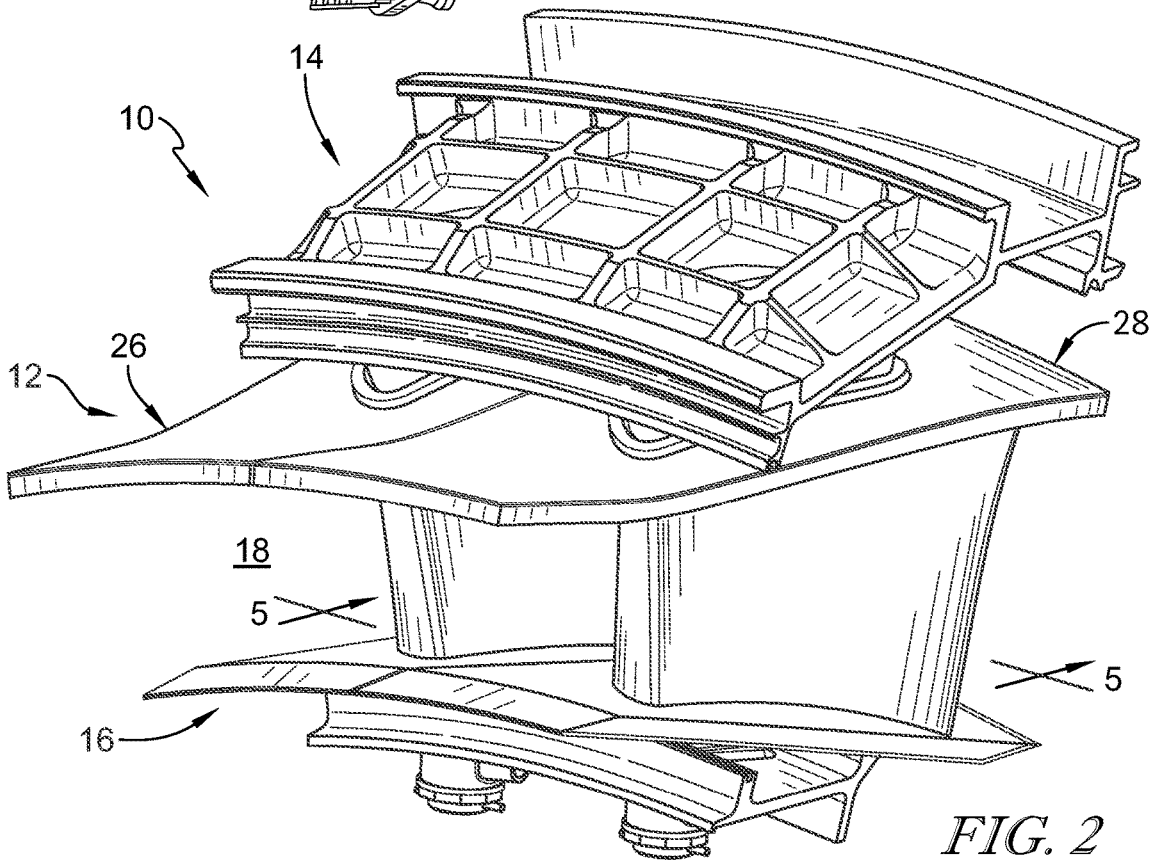
FIG. 2 is a perspective view of a turbine vane assembly of one of the static turbine vane rings of FIG. 1 showing the turbine vane assembly includes a plurality of turbine vanes adapted to interact with hot gases flowing through a gas path of the gas turbine engine, an outer vane support that extends radially through the turbine vanes to receive force loads from the turbine vanes, and an inner vane support arranged radially inward of the outer vane support and coupled to the outer vane support.

A turbine vane assembly 10 for use in a gas turbine engine 110 is shown in FIG. 2. The turbine vane assembly 10 includes a plurality of turbine vanes 12, an outer vane support 14, and an inner vane support 16 as shown in FIGS. 2-5. The turbine vanes 12 each interact with hot gases conducted through a gas path 18 of the gas turbine engine 110 and conducts the hot gases around the turbine vane assembly 10 toward a rotating wheel assembly 24 located downstream of the turbine vane assembly 10 as suggested in FIG. 4. The outer vane support 14 is located radially outward of and extends radially into the turbine vanes 12 and is configured to receive force loads applied to the vanes 12 by the hot gases. The inner vane support 16 is spaced apart radially from the outer support 14 relative to the axis to locate the plurality of turbine vanes 12 radially between. The inner vane support 16 is coupled with the outer vane support 14 to provide a mechanical linkage between the plurality of turbine vanes 12 and reduce twisting of the turbine vane assembly 10 relative to adjacent turbine vane assemblies during use of the turbine vane assembly 10 in the gas turbine engine 110.

The vanes 12 comprise ceramic materials, while the outer and inner vane supports 14, 16 comprise metallic materials in the illustrative embodiment. As such, the ceramic matrix composite vanes 12 are adapted to withstand high temperatures, but may have relatively low strength compared to the metallic vane supports 14, 16. The vane supports 14, 16 provide structural strength to the turbine vane assembly 10 by receiving the force loads applied to the vanes 12 and transferring them to a casing 20 that surrounds the turbine vane assembly 10.

The turbine vane assembly 10 is adapted for use in the gas turbine engine 110, which includes a fan 112, a compressor 114, a combustor 116, and a turbine 118 as shown in FIG. 1. The fan 112 is driven by the turbine 118 and provides thrust for propelling an aircraft. The compressor 114 compresses and delivers air to the combustor 116. The combustor 116 mixes fuel with the compressed air received from the compressor 114 and ignites the fuel. The hot, high pressure products of the combustion reaction in the combustor 116 are directed into the turbine 118 to cause the turbine 118 to rotate about an axis 19 of the gas turbine engine 110 and drive the compressor 114 and the fan 112. In other embodiments, the fan 112 may be omitted and the turbine 118 drives a propeller, drive shaft, or other suitable alternative.

Figure 4:
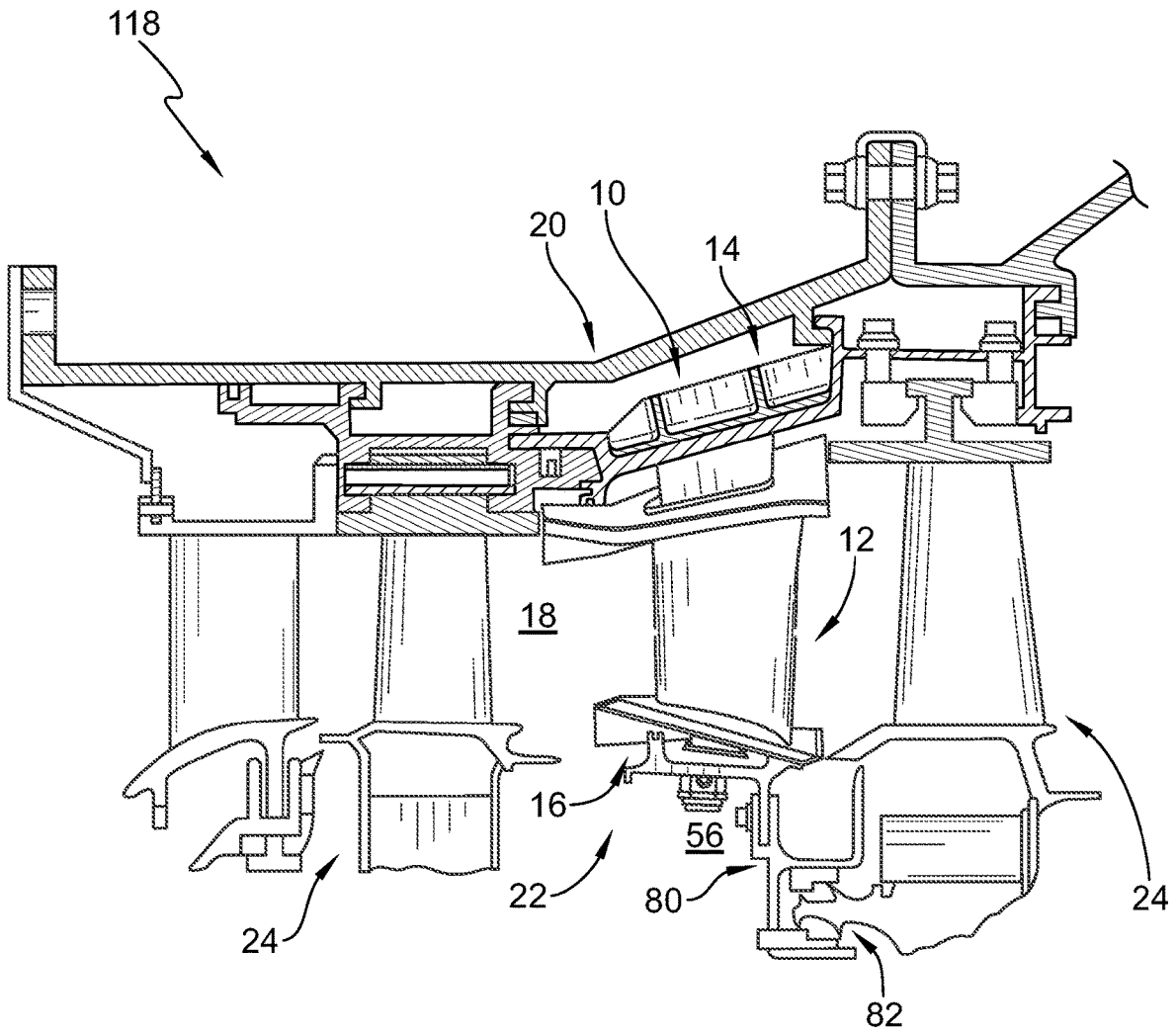
FIG. 4 is a section view of a portion of the turbine included in the gas turbine engine of FIG. 1 showing the turbine vane assembly and portion of the turbine casing and rotating wheel assemblies.

The turbine 118 includes a turbine case 20, a plurality of static turbine vane rings 22 that are fixed relative to the axis 19, and a plurality of bladed rotating wheel assemblies 24 as suggested in FIGS. 1 and 4. Each turbine vane ring 22 includes a plurality of turbine vane assemblies 10. The hot gases are conducted through the gas path 18 and interact with the bladed wheel assemblies 24 to cause the bladed wheel assemblies 24 to rotate about the axis 19. The turbine vane rings 22 are positioned to direct the gases toward the bladed wheel assemblies 24 with a desired orientation.

The force loads received by the outer and inner vane supports 14, 16 from the turbine vanes 12 and/or other components 80 of the gas turbine engine 110 may impart a rotation on each turbine vane assembly 10 included in the turbine vane ring 22. The resulting rotation may result in increased leakage between the vane assemblies 10. To minimize twisting between assemblies 10, the outer and inner vane supports 14, 16 are arranged to extend partway about the axis 19 and provide a mechanical linkage between circumferentially adjacent turbine vanes 12. The increased surface area and structural reinforcement at both radially outer and inner ends of the turbine vane 12 reduces the non-trivial rotation between adjacent turbine vane assemblies 10 and therefore reduces the leakage and increases engine 110 performance.

Figure 3:
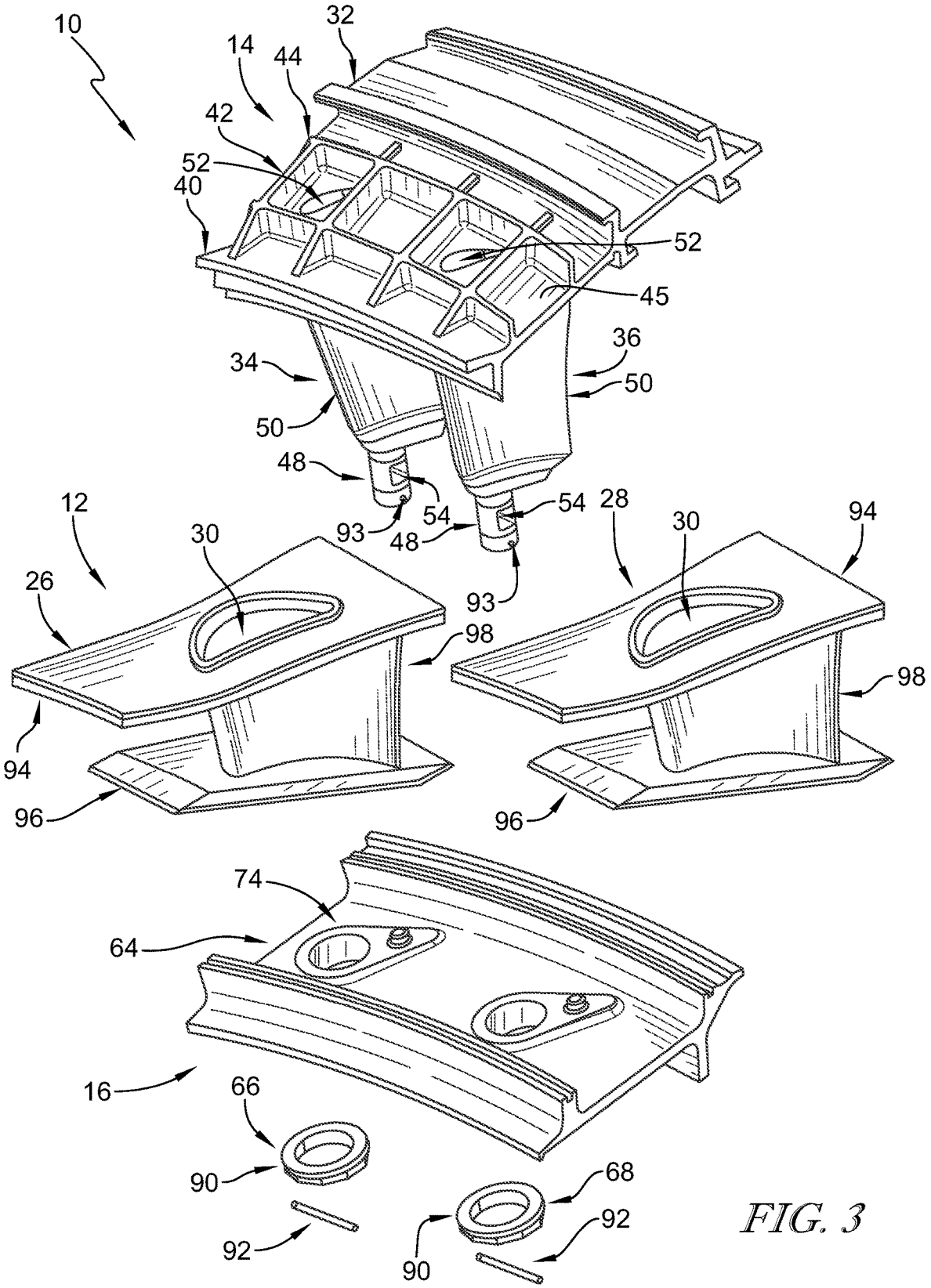
FIG. 3 is an exploded view of the turbine vane assembly of FIG. 2 showing the outer vane support includes an outer mount that couples to a turbine casing and a plurality of support spars that extend radially inward from the outer vane support through a corresponding turbine vane, and further showing the inner vane support includes an inner mount that extends partway around the axis and a plurality of fasteners configured to couple one of the support spars to the inner mount and form a mechanical linkage between the plurality of turbine vanes.
Figure 5:
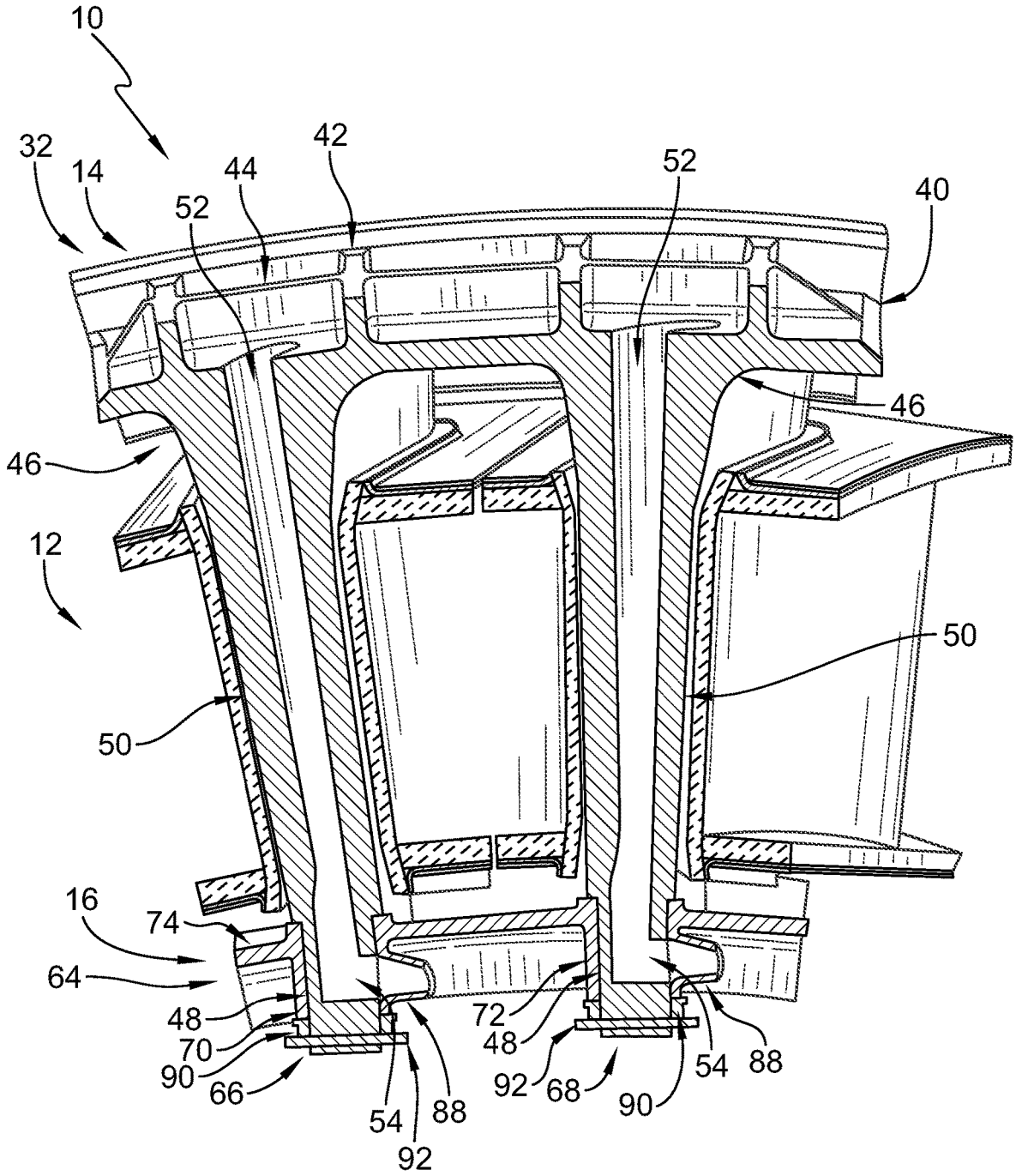
FIG. 5 is a section view of the turbine vane assembly of FIG. 2 taken along line 5-5 showing the first support spar and second support spar are integrally formed with the outer mount platform and each is shaped to include a cooling channel that extends radially through the support spars and opens radially inward of the inner vane support.

The plurality of turbine vanes 12 includes a first turbine vane 26 and a second turbine vane 28 as shown in FIGS. 2, 3, and 5. The second turbine vane 28 is spaced apart circumferentially from the first turbine vane 26. Each of the turbine vanes 26, 28 are shaped to define an interior cavity 30 that extends radially through each turbine vane 26, 28 as shown in FIG. 3.

The outer vane support 14 includes an outer mount 32, a first support spar 34, and a second support spar 36 as shown in FIGS. 3 and 5. The outer mount 32 extends circumferentially at least partway about the axis 19 and is configured to be coupled to the turbine case 20. The first support spar 34 extends radially inward from the outer mount 32 through the interior cavity 30 of the first turbine vane 26. The second support spar 36 is spaced apart circumferentially from the first support spar 34 and extends radially inward from the outer mount 32 through the interior cavity 30 of the second turbine vane 28. The outer mount 32, the first support spar 34, and the second support spar 36 are integrally formed as a single piece, unitary outer vane support 14 component.

The outer mount 32 includes an outer mount platform 40 and a plurality of reinforcement extensions 42, 44 as shown in FIGS. 3 and 5. In the illustrative embodiment, the reinforcement extensions 42, 44 include axially extending reinforcement ribs 42 and circumferentially extending reinforcement ribs 44. The axially extending reinforcement ribs 42 extend radially outward from and axially extend along an outer surface 45 of the outer mount platform 40 relative to the axis 19. The circumferentially extending reinforcement ribs 44 extend radially outward from and circumferentially along the outer surface 45 of the outer mount platform 40 relative to the axis 19. The axial and circumferential reinforcement ribs 42, 44 cooperate to reinforce the outer mount 32 and stiffen the outer mount platform 40, minimizing the compliance of the outer mount 32 and resulting deflections.

In some embodiments, the reinforcement ribs 42, 44 may be configured to help minimize the axial deflection of the turbine vane assembly 10. The reinforcement ribs 42, 44 may also be configured to help minimize resulting stresses in the outer mount platform 40 due to twisting of the turbine vane assembly 10.

Figure 7:
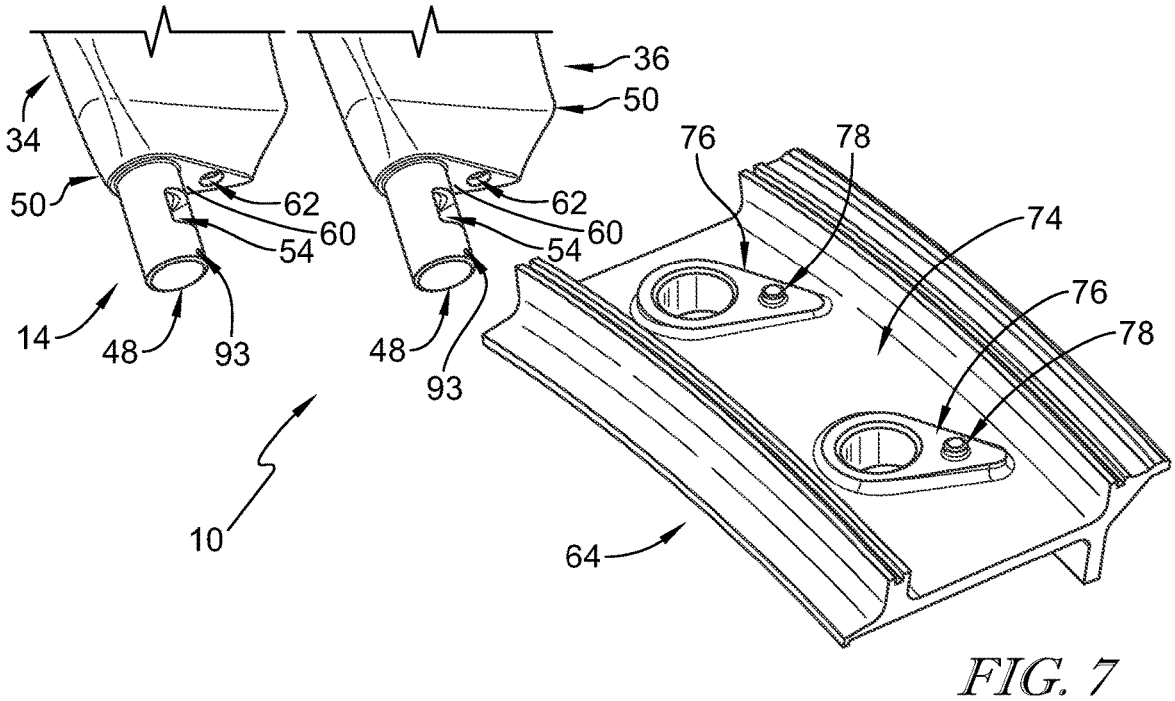
FIG. 7 is an exploded view of a portion of the vane support of the turbine vane assembly of FIG. 2 showing the interface between the outer vane support and the inner vane support includes anti-rotation features to block relative movement of the outer vane support relative to the inner vane support.

Each of the support spars 34, 36 include an outer end 46, an inner end 48, and a strut 50 as shown in FIGS. 3, 5, and 7. The outer end 46 is integrally formed with the outer mount platform 40 in the illustrative embodiment. The inner end 48 is spaced radially inward from the outer end 46 relative to the axis 19 and coupled to the inner vane support 16. The strut 50 extends between and interconnects the outer end 46 and the inner end 48.

Each of the support spars 34, 36 are also shaped to include a cooling channel 52 as shown in FIGS. 3 and 5. The cooling channel 52 extends radially through the support spar 34, 36 and is configured to transmit a flow of cooling air through the turbine vane assembly 10 radially inward of the inner vane support 16. In some embodiments, the support spars 34, 36 may also include impingement holes (not shown) that may be configured to conduct a flow of cooling air to each vane 26, 28 in the interior cavity 30.

The inner end 48 of each support spar 34, 36 is shaped to include a cooling air exit hole 54 as shown in FIGS. 3, 5, and 7. The exit hole 54 extends at least partway through the inner end 48 of the support spar 34, 36 and is in fluid communication with the cooling channel 52 of the support spar 34, 36. The exit hole 54 is configured to transmit the flow of cooling air to an inner cavity 56 radially inward of the inner vane support 16.

The strut 50 of each support spar 34, 36 is shaped to include inner interface surface 60 and an anti-rotation notch 62 as shown in FIG. 7. The inner interface surface 60 is configured to engage the inner vane support 16 and block radial outward movement of the inner vane support 16 relative to the outer vane support 14. The anti-rotation notch 62 extends radially outward into inner interface surface 60 of the strut 50. The anti-rotation notch 62 is configured to mate with an anti-rotation feature 78 in the inner vane support 16 to block relative movement between the support spar 34, 36 and the inner vane support 16.

Figure 6:
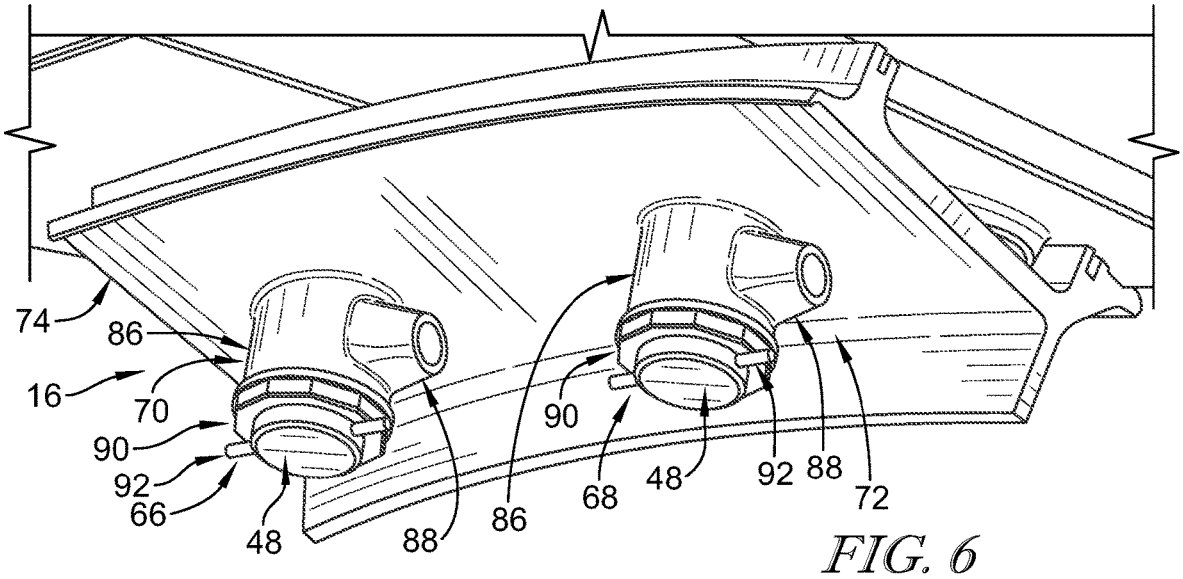
FIG. 6 is a perspective view of the inner vane support of the turbine vane assembly of FIG. 2 showing the inner mount includes an inner mount platform and a plurality of nozzles integrally formed with the inner mount platform and configured to receive an inner end of one support spar of the plurality of support spars.

The inner vane support 16 includes an inner mount 64, a plurality of fasteners 66, 68, and a plurality of nozzles 70, 72 as shown in FIGS. 3, 5, and 6. The inner mount 64 is arranged radially inward of the turbine vanes 26, 28. Each fastener 66, 68 of the plurality of fasteners 66, 68 is configured to couple the corresponding support spar 34, 36 to the inner mount 64. Each nozzle 70, 72 is arranged radially inward of the inner mount 64 and is configured to receive the inner end 48 of the corresponding support spar 34, 36 to direct the flow of cooling air transmitted by the cooling channel 52 of the corresponding support spar 34, 36.

In the illustrative embodiment, the inner mount 64 is configured to be coupled to an inter-stage seal 80 included in the turbine section 118 as shown in FIG. 4. The inter-stage seal 80 is configured to be engaged by a rotating component 82 of the adjacent turbine wheel 24 to create a compartment seal separating the inner cavity 56. The engagement of the inter-stage seal 80 and the rotor 82 of the turbine wheel 24 creates a pressure difference across the inter-stage seal 80 during use of the turbine vane assembly 10 in the gas turbine engine 110. The difference of pressure causes a pressure force to act on the inter-stage seal 80, which results in an axial moment in the turbine vane assembly 10. The increased surface area of the outer mount platform 40 minimized the deflection of the outer vane support 14 due to this axial moment.

In the illustrative embodiment, the plurality of fasteners 66, 68 includes a first fastener 66 and a second fastener 68 as shown in FIGS. 3, 5, and 6. The first fastener 66 is configured to couple the inner end 48 of the first support spar 34 to the inner mount 64. The second fastener 68 is configured to couple the inner end 48 of the second support spar 36 to the inner mount 64.

In the illustrative embodiment, the plurality of nozzles 70, 72 includes first nozzle 70 and a second nozzle 72 as shown in FIGS. 3, 5, and 6. The first nozzle 70 extends radially inward from the inner mount platform 74. The second nozzle 72 is spaced apart from the first nozzle 70 and extends radially inward from the inner mount platform 74. Each nozzle 70, 72 is to receive the inner end 48 of the corresponding support spar 34, 36.

In the illustrative embodiment, the nozzles 70, 72 are integrally formed with the inner mount 64 such that the inner mount 64, the first nozzle 70, and the second nozzle 72 are a one-piece, integral component. In other embodiments, the nozzles 70, 72 may be separate pieces from the inner mount 64.

The inner mount 64 includes an inner mount platform 74, raised interface surfaces 76, and anti-rotation pegs 78 as shown in FIG. 7. The inner mount platform 74 extends at least partway about the axis 19. Each raised interface surface 76 extends radially outward from the inner mount platform 74 and is configured to engage the inner interface surface 60 of the corresponding strut 50. The anti-rotation peg 78 extends radially outward from the raised interface surface 76 and into the anti-rotation notch 62 in the corresponding strut 50 to block twisting of the inner mount platform 74 relative to the support spar 34, 36.

In the illustrative embodiment, the inner mount platform 74 is machined to form the raised interface surfaces 76. In other embodiments, the inner mount platform 74 may be machined so that the interface surfaces 76 extend radially into the inner mount platform 74.

In the illustrative embodiment, the anti-rotation peg 78 extends radially outward from the inner mount platform 74. In other embodiments, the anti-rotation feature arrangement may be reversed so that the anti-rotation notch 62 is machined into the inner mount platform 74 and the strut 50 of the support spar 34, 36 includes the anti-rotation peg 78.

Each nozzle 70, 72 includes a cylindrical tube 86 and a spout 88 as shown in FIGS. 5 and 6. The tube 86 extends radially inward from the inner mount platform 74 and receives the inner end 48 of the support spar 34, 36. The spout 88 extends circumferentially from the cylindrical tube 86. The spout 88 is configured to align with the exit hole 54 formed in the inner end 48 of the support spar 34, 36 so that the flow of cooling air is discharged out of the spout 88 in a circumferential direction about the axis.

Each fastener 66, 68 includes a nut 90 and a pin 92 as shown in FIGS. 3, 5, and 6. The nut 90 is configured to mate with threads formed on the inner end 48 of the support spar 34, 36. The pin 92 extends through a pin hole 93 formed in the inner end 48 of the support spar 34, 36 to block removal of the nut 90 off the inner end 48.

In other embodiments, the fastener may only include the pin 92. In such embodiments, the pin 92 may extend through a portion of the nozzle 70, 72 to block removal of the nozzle 70, 72 from the inner end 48 of the support spar 34, 36. In other embodiments, the pin 92 may extend through a portion of the inner mount platform 74 into the inner end 48 of the support spar 34, 36 to couple the support spar 34, 36 to the inner mount platform 74. In other embodiments, the fastener may be another suitable nut-locking feature or joint coupling.

In the illustrative embodiment, each nut 90 engages the corresponding nozzle 70, 72 to cause the raised interface surface 76 of the inner mount platform 74 to engage the inner interface surface 60 of the strut 50. The maintained engagement of the inner mount 64 with the strut 50 maintains the anti-rotation features and minimizes twisting of the vane supports 14, 16.

Turning again to the turbine vanes 26, 28, each turbine vane 26, 28 is shaped to include an outer platform 94, an inner platform 96, and an airfoil 98 as shown in FIG. 3. The outer platform 94 defines an outer boundary of the gas path 18. The inner platform 96 is spaced apart radially from the outer platform 94 relative to the axis 19 to define an inner boundary of the gas path 18. The airfoil 98 extends radially between and interconnects the outer platform 94 and the inner platform 96. The airfoil 98 is shaped to redirect gases flowing through the gas path 18 and to shield the outer vane support 14 from the hot gases in the gas path 18.

The airfoil 98 is also formed to define the interior cavity 30 that extends radially into the airfoil 98 as shown in FIG. 3. Illustratively, the interior cavity 30 extends radially entirely through the outer platform 94, the inner platform 96, and the airfoil 98.

In the illustrative embodiment, the outer platform 94, the inner platform 96, and the airfoil 98 of the vane 26, 28 are integrally formed from ceramic matrix composite materials. As such, the outer platform 94, the inner platform 96, and the airfoil 98 provide a single, integral, one-piece vane 26, 28 as shown in FIG. 4. In other embodiments, the outer platform 94, the inner platform 96, and the airfoil 98 may be formed as separate components and coupled together.

A method of assembling the turbine vane assembly 10 may include several steps. The method may include arranging the first support spar 34 through the first turbine vane 26, arranging the second support spar 36 through the second turbine vane 28, and coupling the inner mount 64 to the inner ends 48 of the first support spar 34 and the second support spar 36.

In the illustrative embodiment, the coupling step includes arranging the inner end 48 of each support spar 34, 36 through corresponding apertures in the inner mount platform 74 and into the corresponding nozzles 70, 72, fixing the first fastener 66 to the inner end 48 of the first support spar 34, and fixing the second fastener 68 to the inner end 48 of the second support spar 36.

In the illustrative embodiment, the arranging step of the inner end 48 of the support spars 34, 36 includes engaging the interface surface 60 of each support spar 34, 36 with the raised interface surface 76 on the inner mount 64. The arranging step may also include engaging the anti-rotation peg 78 extends into the anti-rotation notch 62 in the strut 50 so as to align the exit holes 54 with the corresponding spout 88 of the nozzles 70, 72. In the illustrative embodiment, the fixing step of the fasteners 66, 68 includes mating the nut 90 with the threads of the inner end 48 of the support spar 34, 36 and arranging the pin 92 in the pin hole 93 in the inner end 48 of the support spar 34, 36.

Figure 8:
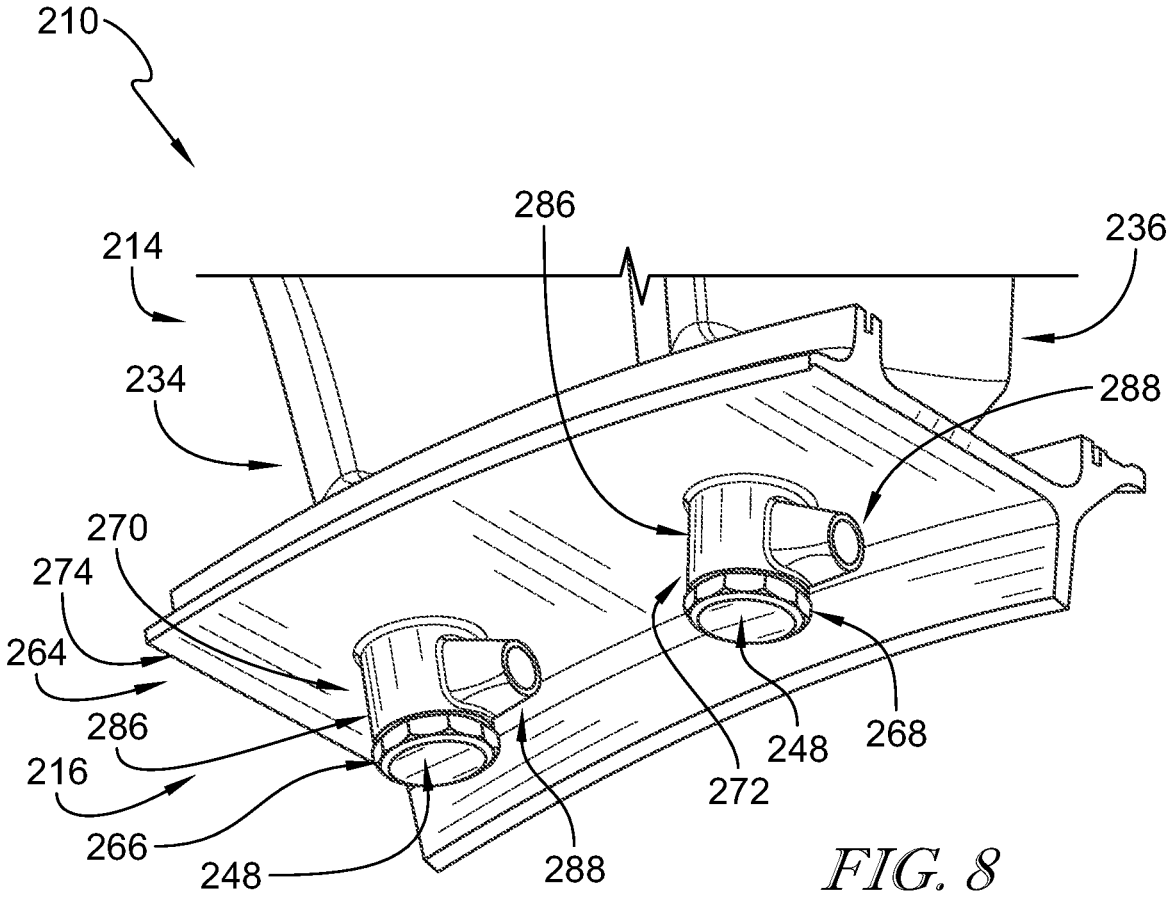
FIG. 8 is a perspective view of another embodiment of a turbine vane assembly showing the turbine vane assembly includes an outer vane support and an inner vane support, the inner vane support including an inner mount extending at least partway about an axis and a plurality fasteners configured to couple the inner mount to the outer vane support, and further showing the inner mount includes an inner platform and a plurality of non-integral nozzles configured to receive a portion of the outer vane support.
Figure 9:
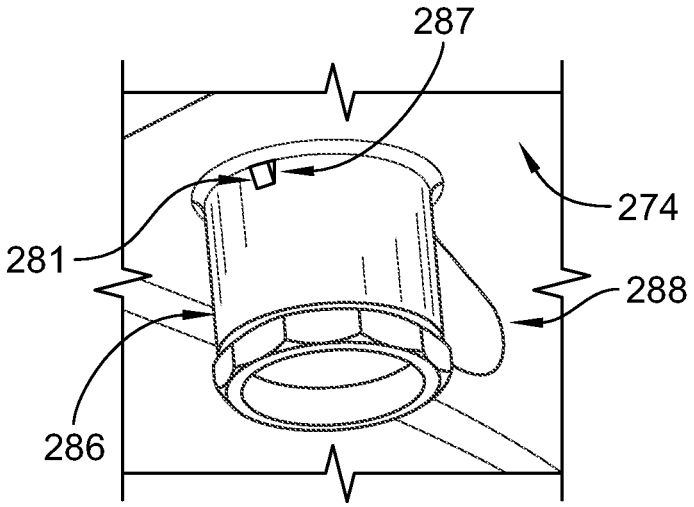
FIG. 9 is a detail perspective view of the inner vane support of FIG. 8 showing the each nozzle is shaped to include an anti-rotation notch that is configured to mate with an anti-rotation tab formed on the inner mount platform to block rotation of the nozzle relative to the inner mount platform.

Another embodiment of a turbine vane assembly 210 in accordance with the present disclosure is shown in FIGS. 8 and 9. The turbine vane assembly 210 is substantially similar to the turbine vane assembly 10 shown in FIGS. 1-7 and described herein. Accordingly, similar reference numbers in the 200 series indicate features that are common between the turbine vane assembly 10 and the turbine vane assembly 210. The description of the turbine vane assembly 10 is incorporated by reference to apply to the turbine vane assembly 210, except in instances when it conflicts with the specific description and the drawings of the turbine vane assembly 210.

The turbine vane assembly 210 includes a plurality of turbine vanes 12, an outer vane support 214, and an inner vane support 216 as shown in FIG. 8. The outer vane support 214 is located radially outward of the turbine vanes 12 and is configured to receive force loads applied to the vanes 12 by the hot gases. The inner vane support 216 is coupled with the outer vane support 214 to provide a mechanical linkage between the plurality of turbine vanes 12 and reduce twisting of the turbine vane assembly 210 relative to adjacent turbine vane assemblies during use of the turbine vane assembly 210 in the gas turbine engine 110.

The inner vane support 216 includes an inner mount 264, a plurality of fasteners 266, 268, and a plurality of nozzles 270, 272 as shown in FIG. 8. The inner mount 264 is arranged radially inward of the turbine vanes 12. Each fastener 266, 268 of the plurality of fasteners 266, 268 is configured to couple one of a first support spar 234 and a second support spar 236 of the outer vane support 214 to the inner mount 264. Each nozzle 270, 272 is arranged radially inward of the inner mount 264 and is configured to receive an inner end 248 of the corresponding support spar 234, 236 to direct the flow of cooling air transmitted by the corresponding support spar 234, 236. In the illustrative embodiment, the nozzles 270, 272 are separate components from the inner mount 264.

The inner mount 264 includes an inner mount platform 274 and anti-rotation tabs 281 as shown in FIGS. 8 and 9. The inner mount platform 274 extends at least partway about the axis 19. Each anti-rotation tab 281 extends radially inward from the inner mount platform 274 and into a corresponding anti-rotation notch 287 in the corresponding nozzle 270, 272 to block relative movement of the support nozzle 270, 272 relative to the inner mount platform 274.

In the illustrative embodiment, the plurality of fasteners 266, 268 includes a first nut 266 and a second nut 268 as shown in FIG. 8. The first nut 266 is configured to mate with threads on the first support spar 234 and engage the first nozzle 270 to maintain engagement of the nozzle 270 with the anti-rotation tab 281 on the inner mount 264. The second nut 268 is configured to mate with threads on the second support spar 236 and engage the second nozzle 272 to maintain engagement of the nozzle 272 with the anti-rotation tab 281 on the inner mount 264. The nuts 266, 268 are configured to block removal of the inner mount 264 and the nozzles 270, 272 off the support spars 234, 236.

Each nozzle 270, 272 includes a cylindrical tube 286, an anti-rotation notch 287, and a spout 288 as shown in FIGS. 8 and 9. The cylindrical tube 286 is configured to receive the inner end 248 of the corresponding support spar 234, 236. The anti-rotation notch 287 extend into the cylindrical tube 286 and is configured to receive the anti-rotation tab 281 of the inner mount platform 274. The spout 288 extends circumferentially from the cylindrical tube 286 and is configured to discharge a flow of cooling air.

A method of assembling the turbine vane assembly 210 may include several steps. The method may include arranging the first support spar 234 through one of the turbine vanes 12, arranging the second support spar 236 through another turbine vane 12, and coupling the inner mount 264 to the inner ends 248 of the first support spar 234 and the second support spar 236.

In the illustrative embodiment, the coupling step includes arranging the inner end 248 of each support spar 234, 236 through corresponding apertures in the inner mount platform 274, arranging the first nozzle 270 on the inner end 248 of the first support spar 234, arranging the second nozzle 272 on the inner end 248 of the second support spar 236, fixing the first fastener 266 to the inner end 248 of the first support spar 234, and fixing the second fastener 268 to the inner end 248 of the second support spar 236.

In the illustrative embodiment, the arranging step of the nozzles 270, 272 on the support spars 234, 236 includes placing the cylindrical tube 286 over the inner end 248 of the support spar 234, 236 and aligning the anti-rotation notch 287 with the anti-rotation tab 281 of the inner mount platform 274.

Figure 10:
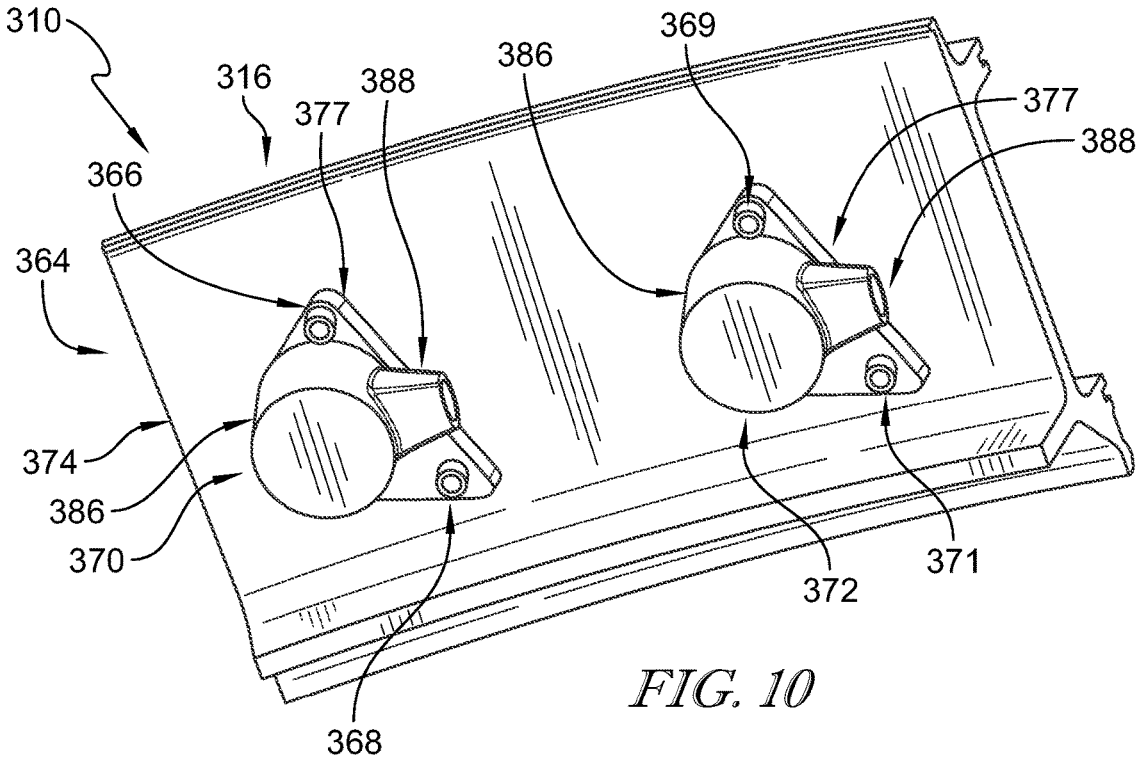
FIG. 10 is a perspective view of another embodiment of a turbine vane assembly showing the turbine vane assembly includes an outer vane support and an inner vane support, the inner vane support including an inner mount and a plurality of fasteners configured to couple a portion of the outer vane support to the inner vane support, and further showing the each of the fasteners include a plurality of bolts that extend through the inner mount into a portion of the outer vane support.
Figure 11:
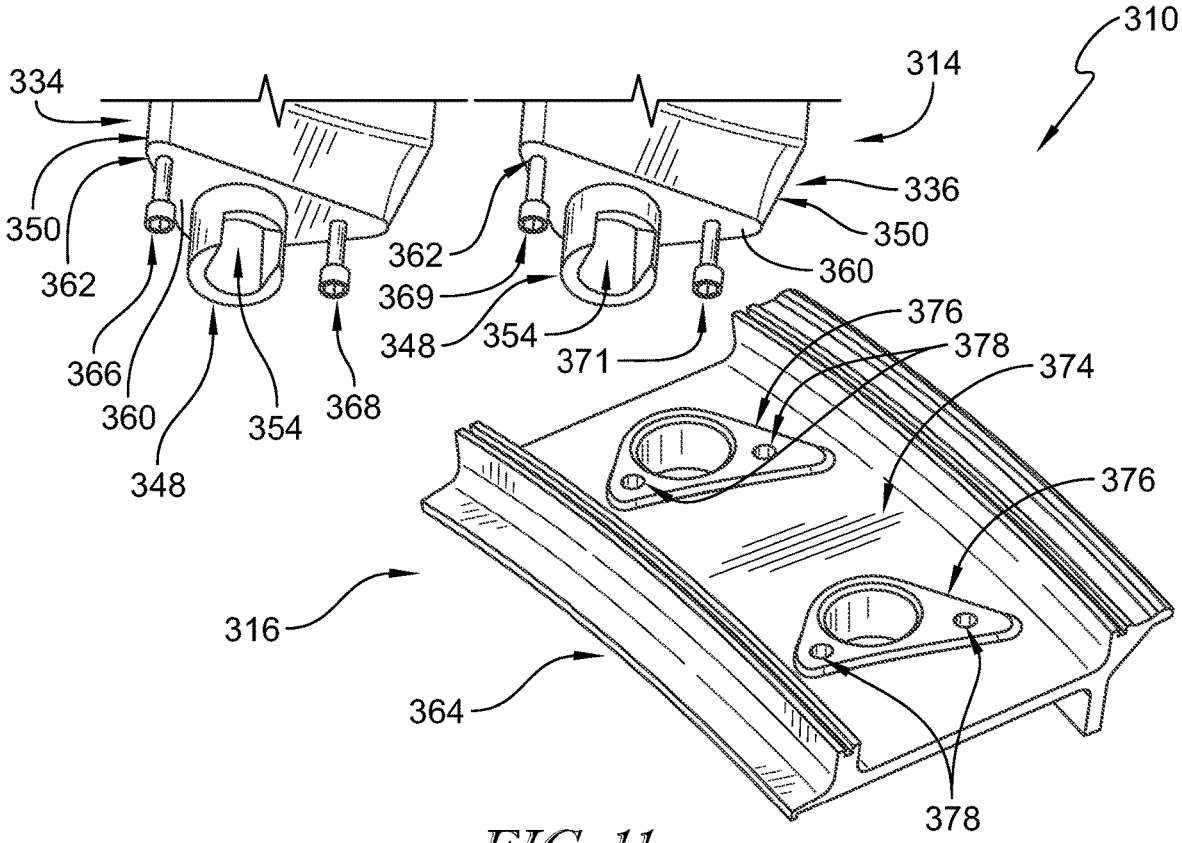
FIG. 11 is an exploded view of a portion of the vane support of the turbine vane assembly of FIG. 10 showing the interface between the outer vane support and the inner vane support.

Another embodiment of a turbine vane assembly 310 in accordance with the present disclosure is shown in FIGS. 10 and 11. The turbine vane assembly 310 is substantially similar to the turbine vane assembly 10 shown in FIGS. 1-7 and described herein. Accordingly, similar reference numbers in the 300 series indicate features that are common between the turbine vane assembly 10 and the turbine vane assembly 310. The description of the turbine vane assembly 10 is incorporated by reference to apply to the turbine vane assembly 310, except in instances when it conflicts with the specific description and the drawings of the turbine vane assembly 310.

The turbine vane assembly 310 includes a plurality of turbine vanes 12, an outer vane support 314, and an inner vane support 316 as shown in FIGS. 10 and 11. The outer vane support 314 is located radially outward of the turbine vanes 12 and is configured to receive force loads applied to the vanes 12 by the hot gases. The inner vane support 316 is coupled with the outer vane support 314 to provide a mechanical linkage between the plurality of turbine vanes 12 and reduce twisting of the turbine vane assembly 310 relative to adjacent turbine vane assemblies during use of the turbine vane assembly 310 in the gas turbine engine 110.

The outer vane support 314 includes a first support spar 334 and second support spar 336 as shown in FIG. 11. The second support spar 336 is spaced apart circumferentially from the first support spar 334. The first support spar 334 and second support spar 336 each extend radially inward through the corresponding turbine vane 12.

Each of the support spars 334, 336 include an inner end 348 and a strut 350 as shown in FIG. 11. Each strut 350 extends radially through the corresponding turbine vane 12. Each inner end 348 extends radially inward from the corresponding strut 350 and couples to the inner vane support 316.

The inner end 348 of each support spar 334, 336 is shaped to include a cooling air exit hole 354 as shown in FIG. 11. The exit hole 354 extends at least partway through the inner end 348 of the support spar 334, 336 and is in fluid communication with the cooling air channel extending through the support spar 334, 336. The exit hole 354 is configured to transmit the flow of cooling air to the inner cavity 56 radially inward of the inner vane support 316.

The strut 350 of each support spar 334, 336 is shaped to include inner interface surface 360 and bolt holes 362 as shown in FIG. 11. The inner interface surface 360 is configured to engage the inner vane support 316. The bolt holes 362 extend radially into inner interface surface 360 of the strut 350. The bolt holes 362 are configured to receive fasteners 366, 368, 369, 371 included in the inner vane support 316 to block relative movement between the support spar 334, 336 and the inner vane support 316.

The inner vane support 316 includes an inner mount 364, a plurality of fasteners 366, 368, 369, 371, and a plurality of nozzles 370, 372 as shown in FIGS. 10 and 11. The inner mount 364 is arranged radially inward of the turbine vanes 12. The plurality of fasteners 366, 368, 369, 371 are configured to couple the inner mount 364 to support spars 334, 336.

The inner mount 364 includes an inner mount platform 374, raised interface surfaces 376, and bolt holes 378 as shown in FIG. 11. The inner mount platform 374 extends at least partway about the axis 19. The raised interface surface 376 extends radially outward from the inner mount platform 374 and is configured to engage the inner interface surface 360 of the strut 350. The holes 378 extend radially through the inner mount platform 374 and receive a portion of the fasteners 366, 368, 369, 371.

Each nozzle 370, 372 includes an attachment plate 377, a cylindrical tube 386 and a spout 388 as shown in FIG. 10. The tube 386 is integrally formed with the attachment plate 377 and extends radially inward from attachment plate 377. Each tube 386 and receives the inner end 348 of the support spar 334, 336. The spout 388 extends circumferentially from the cylindrical tube 386. The spout 388 is configured to align with the exit hole 354 formed in the inner end 348 of the support spar 334, 336 so that the flow of cooling air is discharged out of the spout 388 in a circumferential direction about the axis.

In the illustrative embodiment, each of the fasteners 366, 368, 369, 371 extend through the attachment plate 377 and the inner mount platform 374 of the inner mount 364 into the strut 350 of the corresponding support spar 334, 336 to couple the nozzle 370, 372 to the inner mount platform 374. The fasteners 366, 368, 369, 371 are also configured to act as anti-rotation features and block twisting of the inner vane support 316 relative to the outer vane support 314.

Figure 12:
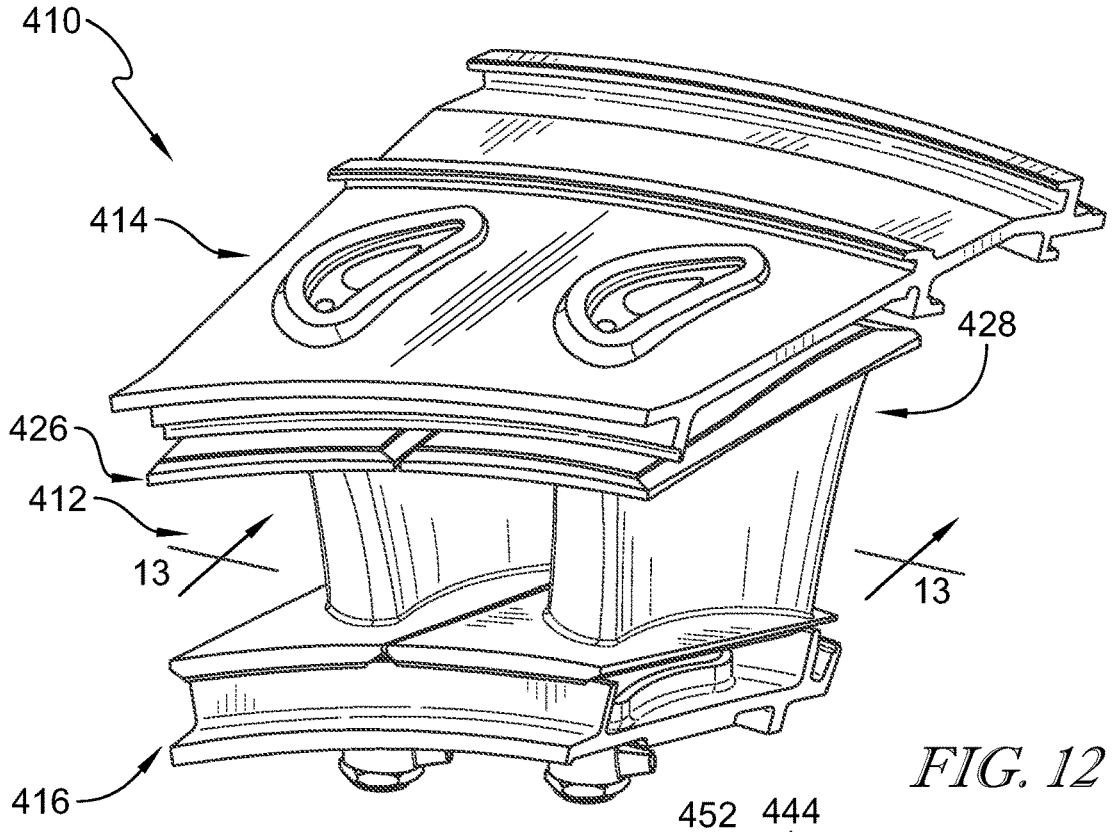
FIG. 12 is a perspective view of another embodiment of a turbine vane assembly showing the turbine vane assembly includes a plurality of turbine vanes, an outer vane support that extends radially through the turbine vanes to receive force loads from the turbine vanes, and an inner vane support arranged radially inward of the turbine vanes and coupled to the outer vane support to locate the turbine vanes radially therebetween.
Figure 13:
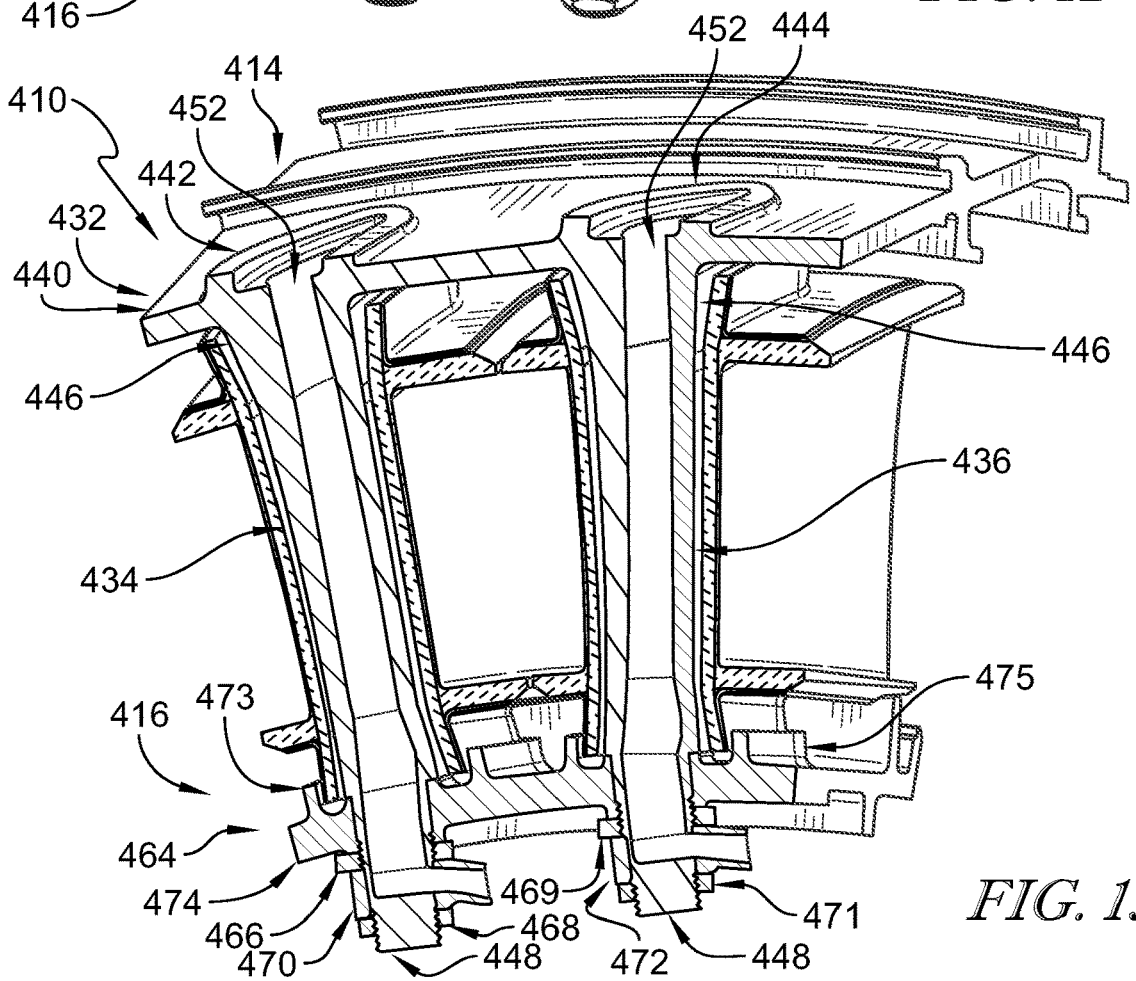
FIG. 13 is a section view of the turbine vane assembly of FIG. 12 taken along line 13-13 showing the outer vane support includes an outer mount that couples to turbine casing and a plurality of support spars that extend radially inward from the outer vane support through a corresponding turbine vane, and further showing the inner vane support includes an inner mount that extends partway around the axis and a plurality of fasteners configured to couple one of the support spars to the inner mount and form the mechanical linkage between the plurality of turbine vanes.
Figure 14:
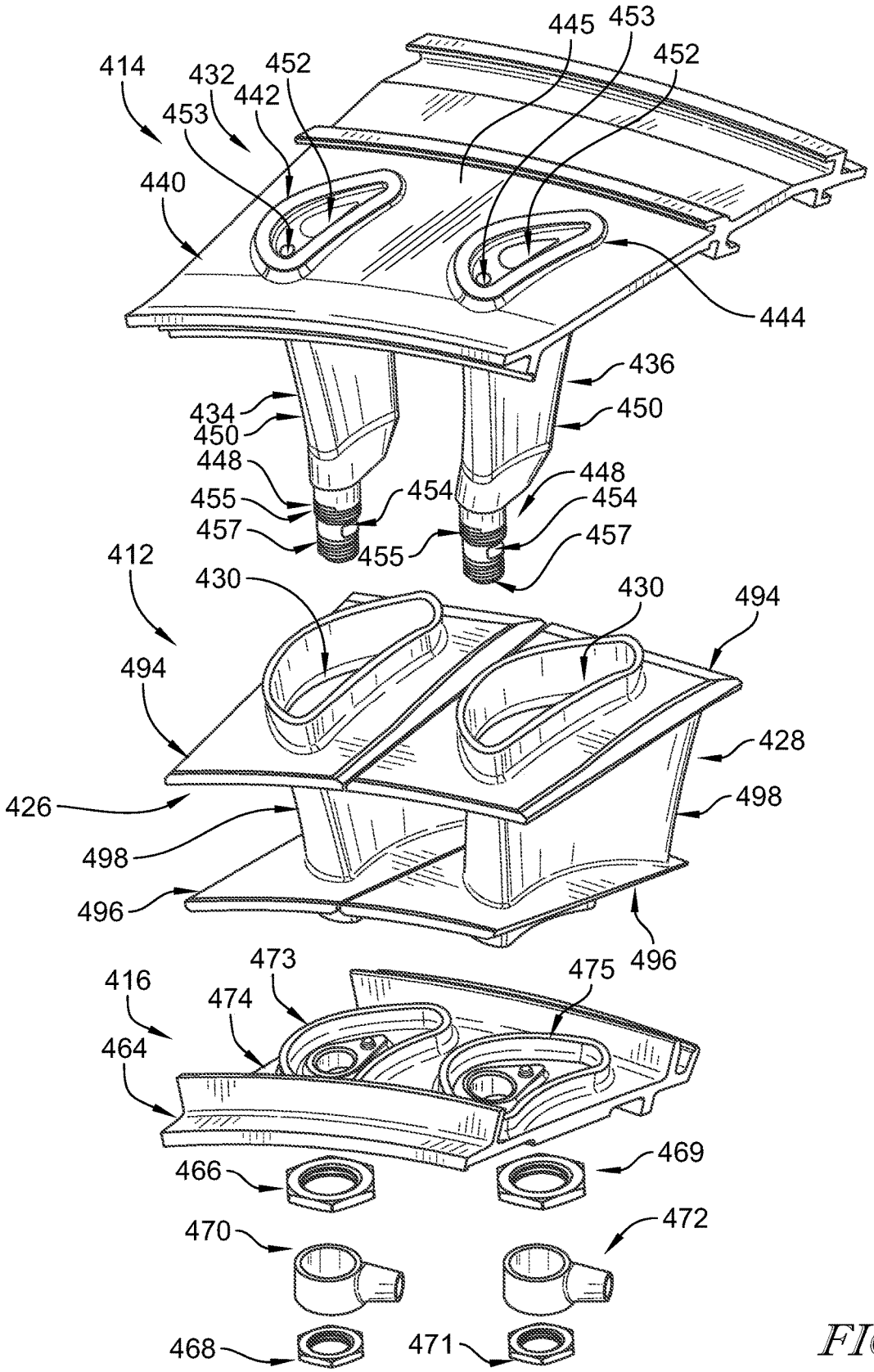
FIG. 14 is an exploded view of the turbine vane assembly of FIG. 13 showing the outer mount includes a plurality of reinforcement collars that extends radially outward from the outer mount at a location radially aligned with the corresponding support spar, and further showing the inner mount includes an inner load transfer collar that extends radially outward from the inner mount and engages the turbine vane to transfer loads at a radially inner end of the turbine vane.

Another embodiment of a turbine vane assembly 410 in accordance with the present disclosure is shown in FIGS. 12-14. The turbine vane assembly 410 is substantially similar to the turbine vane assembly 10 shown in FIGS. 1-7 and described herein. Accordingly, similar reference numbers in the 400 series indicate features that are common between the turbine vane assembly 10 and the turbine vane assembly 410. The description of the turbine vane assembly 10 is incorporated by reference to apply to the turbine vane assembly 410, except in instances when it conflicts with the specific description and the drawings of the turbine vane assembly 410.

The turbine vane assembly 410 includes a plurality of turbine vanes 412, an outer vane support 414, and an inner vane support 416 as shown in FIGS. 12-14. The turbine vanes 412 each interact with hot gases conducted through the gas path 18 of the gas turbine engine 110. The outer vane support 414 is located radially outward of the turbine vanes 412 and is configured to receive force loads applied to the vanes 412 by the hot gases. The inner vane support 416 is coupled with the outer vane support 414 to provide a mechanical linkage between the plurality of turbine vanes 412 and reduce twisting of the turbine vane assembly 410 relative to adjacent turbine vane assemblies during use of the turbine vane assembly 410 in the gas turbine engine 110.

The plurality of turbine vanes 412 includes a first turbine vane 426 and a second turbine vane 428 as shown in FIGS. 12 and 14. The second turbine vane 428 is spaced apart circumferentially from the first turbine vane 426. Each of the turbine vanes 426, 428 are shaped to define an interior cavity 430 that extends radially through each turbine vane 426, 428.

Each turbine vane 426, 428 is shaped to include an outer platform 494, an inner platform 496, and an airfoil 498 as shown in FIG. 14. The outer platform 494 defines an outer boundary of the gas path 18. The inner platform 496 is spaced apart radially from the outer platform 494 relative to the axis 19 to define an inner boundary of the gas path 18. The airfoil 498 extends radially between and interconnects the outer platform 494 and the inner platform 496. The airfoil 498 is shaped to redirect gases flowing through the gas path 18 and to shield the outer vane support 414 from the hot gases in the gas path 18.

The outer vane support 414 includes an outer mount 432, a first support spar 434, and a second support spar 436 as shown in FIGS. 13 and 14. The outer mount 432 extends circumferentially at least partway about the axis 19 and is configured to be coupled to the turbine case 20. The first support spar 434 extends radially inward from the outer mount 432 through the interior cavity 430 of the first turbine vane 426. The second support spar 436 is spaced apart circumferentially from the first support spar 434 and extends radially inward from the outer mount 432 through the interior cavity 430 of the second turbine vane 428.

The outer mount 432 includes an outer mount platform 440 and a plurality of reinforcement extensions 442, 444 as shown in FIGS. 13 and 14. In the illustrative embodiment, the reinforcement extensions 442, 444 include a first reinforcement collar 442 and a second reinforcement collar 444.

The first reinforcement collar 442 extends radially outward from an outer surface 445 of the outer mount platform 440. The second reinforcement collar 444 extends radially outward from the outer surface 445 of the outer mount platform 440. Each of the reinforcement collars 442, 444 is radially aligned with the corresponding support spar 434, 436 and cooperate to reinforce the outer mount 432.

In the illustrative embodiment, the reinforcement collars 442, 444 may stiffen the outer mount platform 440 and minimize the compliance of the outer mount 432 and resulting deflections. In some embodiments, the reinforcement collars 442, 444 may help minimize the axial deflection of the turbine vane assembly 410. The reinforcement collars 442, 444 may also help minimize resulting stresses in the outer mount platform 440 due to the twisting of the turbine vane assembly 410.

Each of the support spars 434, 436 include an outer end 446, an inner end 448, and a strut 450 as shown in FIGS. 13 and 14. The outer end 446 is integrally formed with the outer mount platform 440 in the illustrative embodiment. The inner end 448 is spaced radially inward from the outer end 446 relative to the axis 19 and coupled to the inner vane support 416. The strut 450 extends between and interconnects the outer end 446 and the inner end 448.

Each of the support spars 434, 436 are also shaped to include a cooling channel 452 and an impingement channel 453 as shown in FIGS. 13 and 14. The cooling channel 452 extends radially through the support spar 434, 436 and is configured to transmit a flow of cooling air through the turbine vane assembly 410. The impingement channel 453 is spaced axially forward of the cooling channel 452 and extends radially through at least a portion of the support spar 434, 436.

Each of the impingement channels 453 is configured to supply a flow of cooling air to the vanes 426, 428 in the interior cavity 430 through impingement holes (not shown) in the support spar 434, 436. In some embodiments, the support spars 434, 436 may also be shaped to include impingement holes that extend from the cooling channel 452 and supply the flow of cooling air to the vanes 426, 428 in the interior cavity 430.

The inner end 448 of each support spar 434, 436 is shaped to include a cooling air exit hole 454 as shown in FIG. 14. The exit hole 454 extends at least partway through the inner end 448 of the support spar 434, 436 and is in fluid communication with the cooling channel 452 of the support spar 434, 436. The exit hole 454 is configured to transmit the flow of cooling air to an inner cavity 56 radially inward of the inner vane support 416.

The inner end 448 of each support spar 434, 436 is shaped to include a plurality of threads 455, 457 as shown in FIG. 14. The plurality of threads 455, 457 includes a first group of threads 455 and a second group of threads 457 spaced radially inward of the first group of threads 455. Each group of threads 455, 457 is configured to mate with one of the fasteners 466, 468, 469, 471.

The inner vane support 416 includes an inner mount 464, a plurality of fasteners 466, 468, 469, 471, and a plurality of nozzles 470, 472 as shown in FIGS. 13 and 14. The inner mount 464 is arranged radially inward of the turbine vanes 426, 428. Each fastener 466, 468, 469, 471 of the plurality of fasteners 466, 468, 469, 471 is configured to couple the corresponding support spar 434, 436 to the inner mount 464. Each nozzle 470, 472 is arranged radially inward of the inner mount 464 and is configured to receive the inner end 448 of the corresponding support spar 434, 436 to direct the flow of cooling air transmitted by the cooling channel 452 of the corresponding support spar 434, 436.

In the illustrative embodiment, the plurality of fasteners 466, 468, 469, 471 includes a first fastener 66, a second fastener 68, a third fastener 469, and a fourth fastener 471 as shown in FIGS. 2-5. The first and second fasteners 466, 468 are configured to mate with the inner end 448 of the first support spar 434, while the third and fourth fasteners 469, 471 are configured to mate with the inner end 448 of the second support spar 436.

In the illustrative embodiment, the plurality of nozzles 470, 472 includes first nozzle 470 and a second nozzle 472 as shown in FIGS. 13 and 14. The first nozzle 470 extends radially inward from the inner mount platform 474. The second nozzle 472 is spaced apart from the first nozzle 470 and extends radially inward from the inner mount platform 474. Each nozzle 470, 472 is to receive the inner end 48 of the corresponding support spar 434, 436.

In the illustrative embodiment, each of the fasteners 466, 468, 469, 471 are nuts as shown in FIGS. 13 and 14. One of the nuts 466, 469 is configured to mate with the threads 455 on the inner end 448 of one of the first and second support spars 434, 436 and engage the inner mount platform 474 to maintain engagement of inner mount 464 with the outer vane support 414. The other nut 468, 471 is spaced radially inward of the first nut 466, 469 to locate one of the first nozzle 470 and the second nozzle 472 there between. The other fastener 468, 471 is configured to mate with the threads 457 on the inner end 448 of one of the first support spar 434 and the second support spar 436 and engage one of the first nozzle 470 and the second nozzle 472 to block removal of the one of the first nozzle 470 and the second nozzle 472 off the inner end of the one of the first support spar 434 and the second support spar 436.

The inner mount 64 includes an inner mount platform 474, a first inner load transfer collar 473, and a second inner load transfer collar 475 as shown in FIGS. 13 and 14. The inner mount platform 474 extends circumferentially at least partway about the axis 19. The second inner load transfer collar 475 is spaced apart circumferentially from the first inner load transfer collar 473. Each inner load transfer collar 473, 475 extends radially outward from the inner mount platform 474 and engages the inner vane support extension of the corresponding turbine vane 412.

Figure 15:
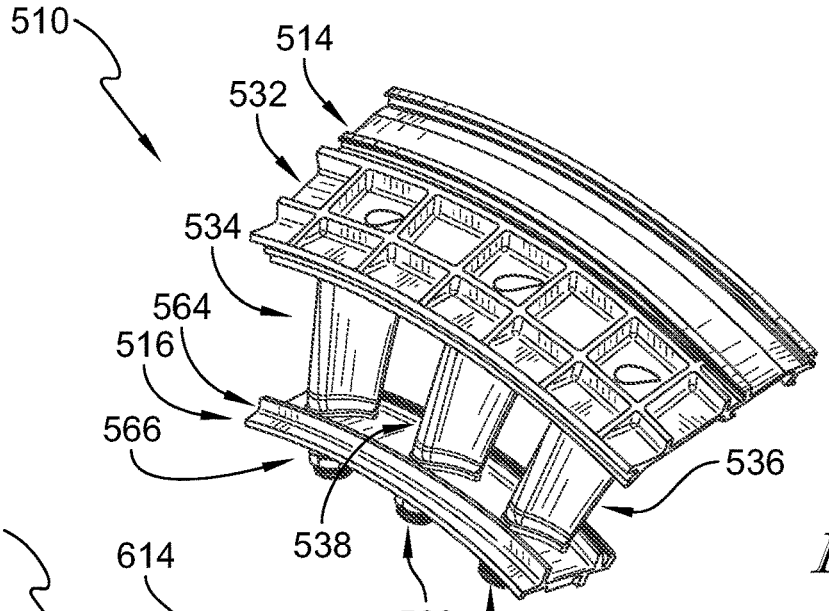
FIG. 15 is a perspective view of another embodiment of a turbine vane assembly showing the turbine vane assembly includes an outer vane support with at least three supports spars that each extend radially inward from an outer mount to receive force loads.

Another embodiment of a turbine vane assembly 510 in accordance with the present disclosure is shown in FIG. 15. The turbine vane assembly 510 is substantially similar to the turbine vane assembly 10 shown in FIGS. 1-7 and described herein. Accordingly, similar reference numbers in the 500 series indicate features that are common between the turbine vane assembly 10 and the turbine vane assembly 510. The description of the turbine vane assembly 10 is incorporated by reference to apply to the turbine vane assembly 510, except in instances when it conflicts with the specific description and the drawings of the turbine vane assembly 510.

The turbine vane assembly 510 includes a plurality of turbine vanes 12, an outer vane support 514, and an inner vane support 516 as shown in FIG. 15. The outer vane support 514 is located radially outward of the turbine vanes 12 and is configured to receive force loads applied to the vanes 12 by the hot gases. The inner vane support 516 is coupled with the outer vane support 514 to provide a mechanical linkage between the plurality of turbine vanes 12 and reduce twisting of the turbine vane assembly 10 relative to adjacent turbine vane assemblies during use of the turbine vane assembly 10 in the gas turbine engine 110.

The outer vane support 514 includes an outer mount 532, a first support spar 534, a second support spar 536, and a third support spar 538 as shown in FIG. 15. The outer mount 532 extends circumferentially at least partway about the axis 19 and is configured to be coupled to the turbine case 20. The first support spar 534 extends radially inward from the outer mount 532 through one of the plurality of turbine vanes 12. The second support spar 536 is spaced apart circumferentially from the first support spar 534 and extends radially inward from the outer mount 532 through one of the plurality of turbine vanes 12. The third support spar 538 is spaced apart circumferentially from the first and second support spars 534, 536 circumferentially in between the first and second support spars 534, 536.

In the illustrative embodiment, the support spars 534, 536, 538 are integrally formed with the outer mount 532. The support spars 534, 536, 538 are integrally formed with the outer mount 532 to reduce the number of gaps.

The inner vane support 516 includes an inner mount 564 and a plurality of couplings 566, 568, 569 as shown in FIG. 15. The inner mount 564 is arranged radially inward of the turbine vanes 12. Each of the couplings 566, 568, 569 is configured to couple the inner mount 564 to each of the corresponding support spars 534, 536, 538.

Figure 16:
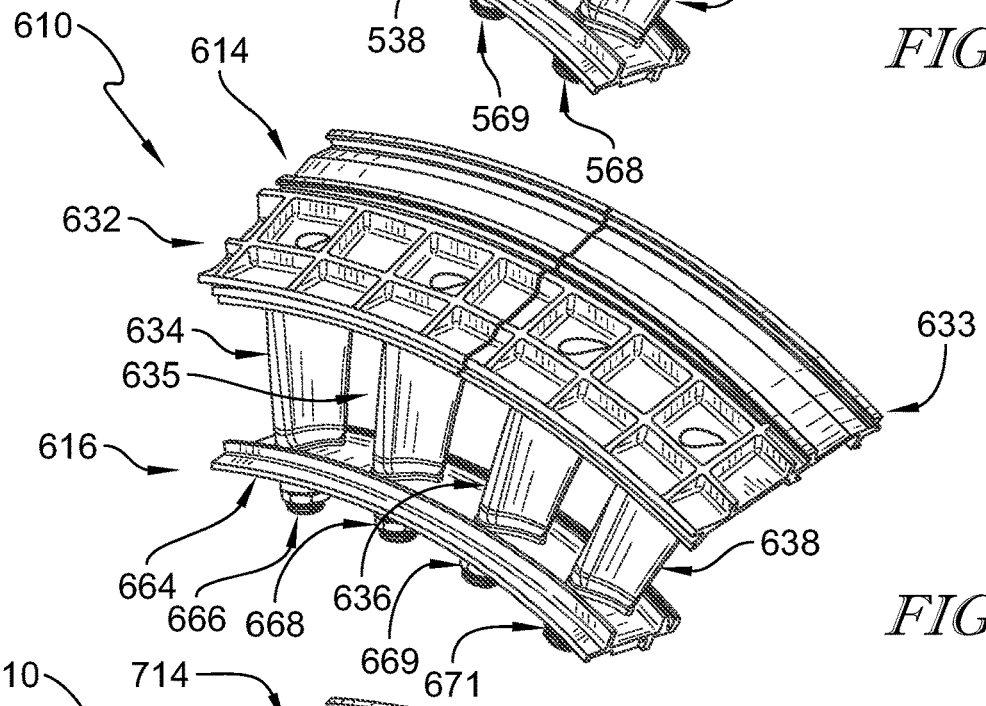
FIG. 16 is a perspective view of another embodiment of a turbine vane assembly showing the turbine vane assembly includes an outer vane support and an inner vane support, the outer vane support including at least two outer mounts and a plurality of support spars that extend radially inward from one of the two outer mounts, and further showing the inner vane support extends at least partway about the axis between the plurality of turbine vanes and is coupled to each of the plurality of support spars.

Another embodiment of a turbine vane assembly 610 in accordance with the present disclosure is shown in FIG. 16. The turbine vane assembly 610 is substantially similar to the turbine vane assembly 10 shown in FIGS. 1-7 and described herein. Accordingly, similar reference numbers in the 600 series indicate features that are common between the turbine vane assembly 10 and the turbine vane assembly 610. The description of the turbine vane assembly 10 is incorporated by reference to apply to the turbine vane assembly 610, except in instances when it conflicts with the specific description and the drawings of the turbine vane assembly 610.

The turbine vane assembly 610 includes a plurality of turbine vanes 12, an outer vane support 614, and an inner vane support 616 as shown in FIG. 16. The outer vane support 614 is located radially outward of the turbine vanes 12 and is configured to receive force loads applied to the vanes 12 by the hot gases. The inner vane support 616 is coupled with the outer vane support 614 to provide a mechanical linkage between the plurality of turbine vanes 12 and reduce twisting of the turbine vane assembly 610 relative to adjacent turbine vane assemblies during use of the turbine vane assembly 610 in the gas turbine engine 110.

The outer vane support 614 includes at least two outer mounts 632, 633 and a plurality of support spars 634, 635, 636, 638 as shown in FIG. 16. A first outer mount 632 is spaced apart circumferentially from a second outer mount 633. Each outer mount 632, 633 extends circumferentially at least partway about the axis 19 and is configured to be coupled to the turbine case 20. Each of the plurality of support spars 634, 635, 636, 638 extends radially inward from one of the at least two outer mounts 632, 633 through one of the plurality of turbine vanes 12. In the illustrative embodiment, the support spars 634, 635, 636, 638 are integrally formed with one of the first outer mount 632 and the second outer mount 633.

The plurality of support spars 634, 635, 636, 638 includes a first support spar 634, a second support spar 635, a third support spar 636, and a fourth support spar 638 as shown in FIG. 16. The support spars 634, 635, 636, 638 are spaced apart circumferentially from one another about the axis 111.

In the illustrative embodiment, the first support spar 636 extends radially inward from the first outer mount 632 through one of the plurality of turbine vanes 12. The second support spar 635 extends radially inward from the first outer mount 632 through another one of the plurality of turbine vanes 12. The third support spar 636 extends radially inward from the second outer mount 633 through another one of the plurality of turbine vanes 12. The fourth support spar 638 extends radially inward from the second outer mount 633 through another one of the plurality of turbine vanes 12.

In other embodiments, the first, second, and third support spars 634, 635, 636 may extend radially inward from the first outer mount 632, while the fourth support spar 638 extends radially inward from the second outer mount 633. Similarly, the first support spar 634 may extend radially inward from the first outer mount 632, while the second, third, and fourth support spars 635, 636, 638 extend radially inward from the second outer mount 633.

The inner vane support 616 includes an inner mount 664 and a plurality of couplings 666, 668, 669, 671 as shown in FIG. 16. The inner mount 664 is arranged radially inward of the turbine vanes 12 and extends at least partway around the axis 19 between the turbine vanes 12. Each of the couplings 666, 668, 669, 671 is configured to couple the inner mount 664 to each of the support spars 634, 635, 636, 638 of the outer vane support 614.

Figure 17:
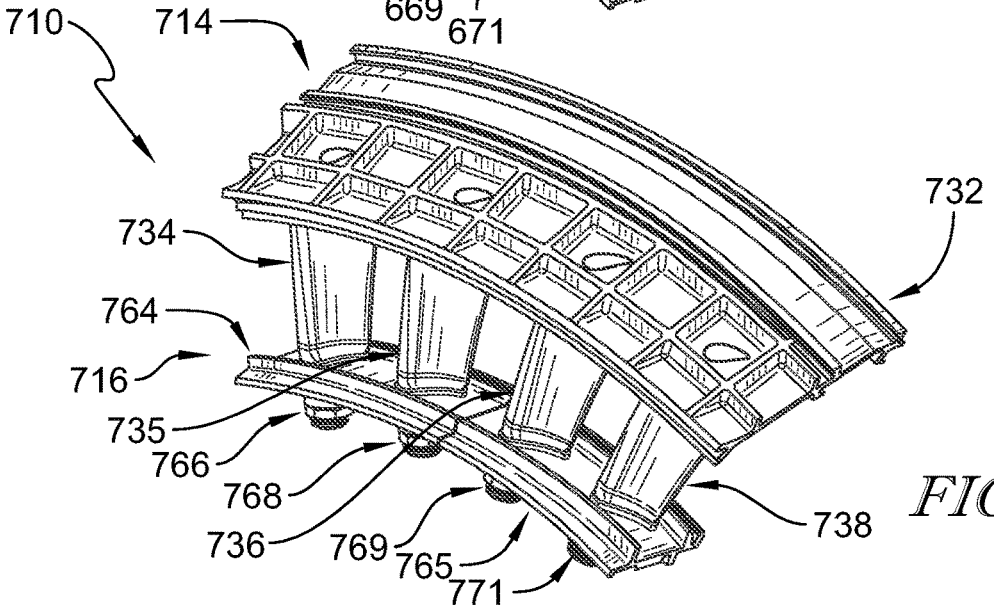
FIG. 17 is a perspective view of another embodiment of a turbine vane assembly showing the turbine vane assembly includes an outer vane support and an inner vane support, the outer vane support including an outer mount that extends at least partway about the axis between the plurality of turbine vanes and a plurality of support spars that extend radially inward from the outer mount, and further showing the inner vane support includes at least two inner mounts that are coupled to at least one of the support spars of the outer vane support.

Another embodiment of a turbine vane assembly 710 in accordance with the present disclosure is shown in FIG. 17. The turbine vane assembly 710 is substantially similar to the turbine vane assembly 10 shown in FIGS. 1-7 and described herein. Accordingly, similar reference numbers in the 700 series indicate features that are common between the turbine vane assembly 10 and the turbine vane assembly 710. The description of the turbine vane assembly 10 is incorporated by reference to apply to the turbine vane assembly 710, except in instances when it conflicts with the specific description and the drawings of the turbine vane assembly 710.

The turbine vane assembly 710 includes a plurality of turbine vanes 12, an outer vane support 714, and an inner vane support 716 as shown in FIG. 17. The outer vane support 714 is located radially outward of the turbine vanes 12 and is configured to receive force loads applied to the vanes 12 by the hot gases. The inner vane support 716 is coupled with the outer vane support 714 to provide a mechanical linkage between the plurality of turbine vanes 12 and reduce twisting of the turbine vane assembly 710 relative to adjacent turbine vane assemblies during use of the turbine vane assembly 710 in the gas turbine engine 110.

The outer vane support 714 includes an outer mount 732 and a plurality of support spars 734, 735, 736, 738 as shown in FIG. 17. The outer mount 732 extends circumferentially at least partway about the axis 19 and is configured to be coupled to the turbine case 20. Each of the plurality of support spars 734, 735, 736, 738 extends radially inward from the outer mount 732 through one of the plurality of turbine vanes 12. In the illustrative embodiment, the support spars 734, 735, 736, 738 are integrally formed with the outer mount 732.

The plurality of support spars 734, 735, 736, 738 includes a first support spar 734, a second support spar 735, a third support spar 736, and a fourth support spar 738 as shown in FIG. 17. The support spars 734, 735, 736, 738 are spaced apart circumferentially from one another about the axis 111.

The inner vane support 716 includes at least two inner mounts 764, 765 and a plurality of couplings 766, 768, 769, 771 as shown in FIG. 17. A first inner mount 764 is spaced apart circumferentially from a second inner mount 765. Each inner mount 764, 765 is arranged radially inward of the turbine vanes 12 and extends circumferentially at least partway about the axis 19. Each of the couplings 766, 768, 769, 771 is configured to couple one of the first inner mount 764 and the second inner mount 765 to at least two of the support spars 734, 735, 736, 738 of the outer vane support 714.

In the illustrative embodiment, the first support spar 734 and the second support spar 735 are coupled to the first inner mount 764, while the third support spar 736 and the fourth support spar 738 are coupled to the second inner mount 765. In other embodiments, the first, second, and third support spars 734, 735, 736 may be coupled to the first inner mount 764, while the four support spar 738 is coupled to the second inner mount 765. Similarly, in other embodiments, the first support spar 734 may be coupled to the first inner mount 764, while the second, third, and fourth support spars 735, 736, 738 are coupled to the second inner mount 765.

Another embodiment of a turbine vane assembly 810 in accordance with the present disclosure is shown in FIGS. 18-21. The turbine vane assembly 810 is substantially similar to the turbine vane assembly 10 shown in FIGS. 1-7 and described herein. Accordingly, similar reference numbers in the 800 series indicate features that are common between the turbine vane assembly 10 and the turbine vane assembly 810. The description of the turbine vane assembly 10 is incorporated by reference to apply to the turbine vane assembly 810, except in instances when it conflicts with the specific description and the drawings of the turbine vane assembly 810.

The turbine vane assembly 810 includes an outer vane support 814 and an inner vane support 816 as shown in FIGS. 18-21. The outer vane support 814 is configured to be located radially outward of the turbine vanes 12 and is configured to receive force loads applied to the vanes 12 by the hot gases. The inner vane support 816 is configured to be coupled with the outer vane support 814 to provide a mechanical linkage between the plurality of turbine vanes 12 and reduce twisting of the turbine vane assembly 810 relative to adjacent turbine vane assemblies 810 during use of the turbine vane assembly 810 in the gas turbine engine 110.

In the illustrative embodiments, the inner vane support 816 includes an inner mount platform 874 and mating features 876, 878 as shown in FIGS. 18-21. The inner mount platform 874 extends at least partway circumferentially about the axis 11. The mating features 876, 878 mate with support spars 834, 836 included in the outer vane support 814 to radially locate the inner mount platform 874 relative to the outer vane support 814 and block rotation of the supports 814, 816 relative to each other.

The mating features 876, 878 mate with the corresponding support spar 834, 836 to block radial and circumferential movement of the metallic outer vane support 814 relative to the metallic inner vane support 816. In other embodiments, plastic deformation may be induced on the support spars, i.e. bending/distorting the support spars during assembly of the support spars with the inner vane support 816. To avoid distortion of the support spars 834, 836, the mating features 876, 878 engage the support spars 834, 836 to independently control the radial and circumferential locations i.e. radial on one spar 836, circumferential on the other spar 834.

In some embodiments, the mating features 876, 878 may be configured to plastically deform upon engagement with the support spars 834, 836. The mating features 876, 878 may plastically deform to lock the inner vane support 816 and the outer vane support 814 together.

In the illustrative embodiments, the inner vane support 816 includes the inner mount platform 874, the first mating feature 876, 877, the second mating feature 878, and a locking pin 879 as shown in FIGS. 18-21. The inner mount platform 874 is configured to be arranged radially inward of the turbine vanes 12. The first mating feature 876, 877 extends radially outward from the inner mount platform 874 and engages the first support spar 834 to engage the first support spar 834. The second mating feature 878 couples with locking tabs 860 on the inner end 848 of the second support spar 836 to block radial movement of the metallic outer vane support 814 relative to the metallic inner vane support 816. The locking pin 879 extends radially through the inner mount platform 874 and into the first support spar 834.

Figure 19:
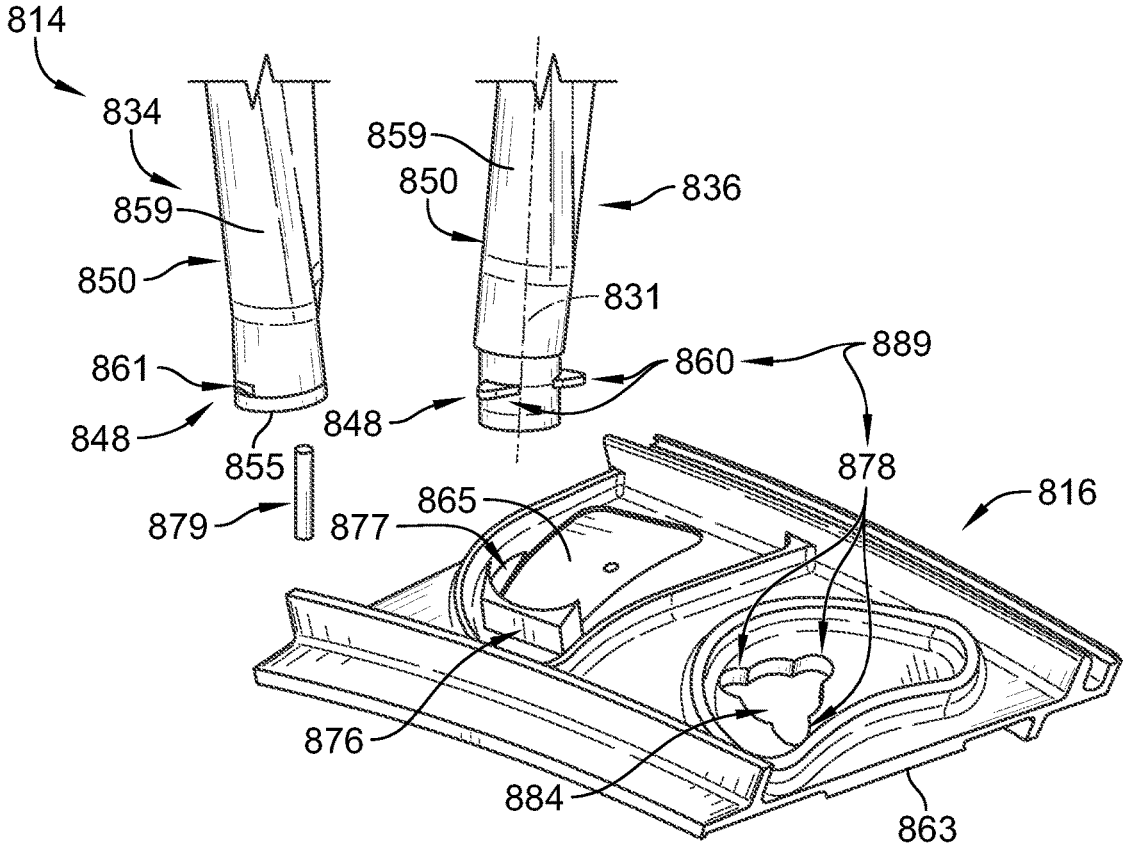
FIG. 19 is an exploded view of a portion of the vane support of the turbine vane assembly of FIG. 18 showing the interface between the outer vane support and the inner vane support includes a bayonet fitting that couples the inner vane support to an inner end of one support spar included in the outer vane support, the bayonet fitting having a plurality of locking tabs formed on the inner end of the one support spar and a plurality of bayonet notches formed on an inner mount platform of the inner vane support that receive the corresponding locking tabs.
Figure 20:
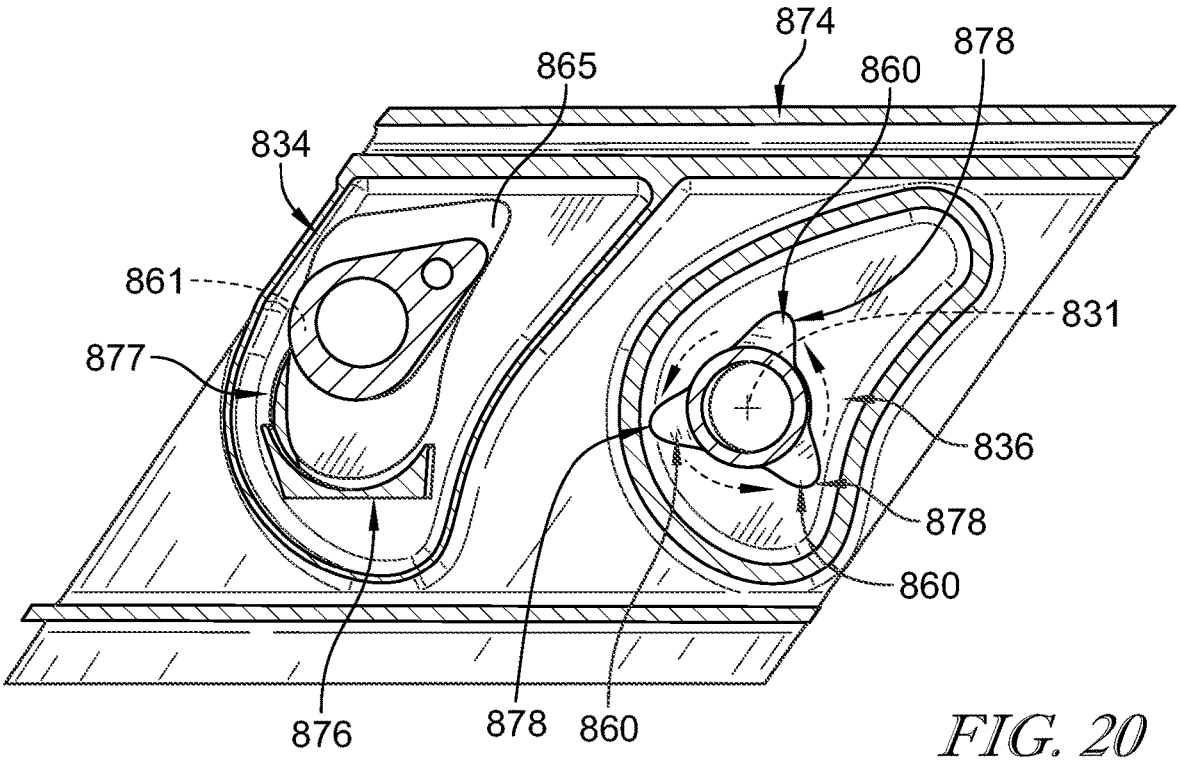
FIG. 20 is a section view of the turbine vane assembly of FIG. 18 taken along line 20-20 showing the locking tabs located in the corresponding bayonet notches before the bayonetting fitting is engaged.
Figure 21:
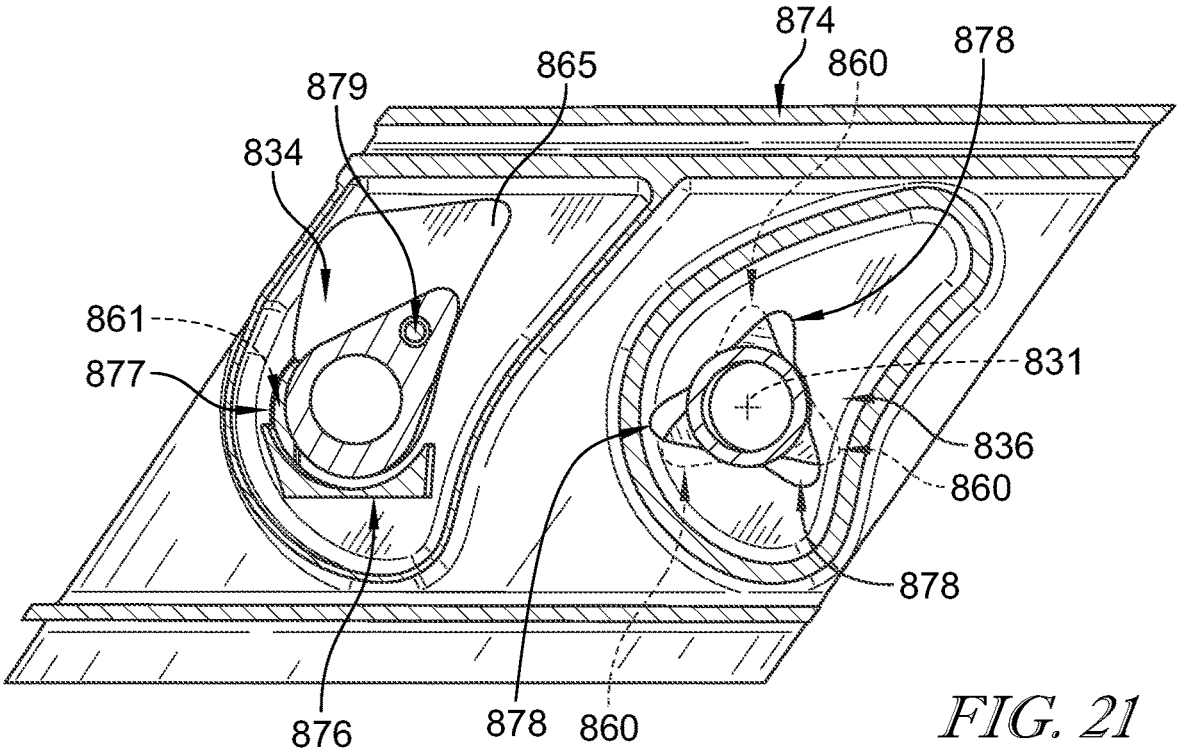
FIG. 21 is a section view similar to FIG. 20 showing the outer vane support rotated about the spar axis so that the locking tabs engage the inner mount platform in the bayonet notches, and further showing the other support spar of the outer vane support engaged with a rotational stop and radial locator formed on the inner mount platform to radially locate and block rotation of the outer vane support relative to the inner vane support.

In the illustrative embodiments, the first mating feature 876, 877 includes a rotational stop 876 and a radial locator 877 as shown in FIGS. 19 and 20. The rotational stop 876 extends radially outward from an outer surface 865 of the inner mount platform 874 at a leading edge of the first support spar 834. The rotational stop 876 provides a load transfer point between the inner vane support 816 and the support spar 834. The radial locator 877 engages the first support spar 834 in a groove 861 formed in the inner end 848 to radially locate the outer vane support 814.

In the illustrative embodiment, a radially-inwardly facing surface 855 of the inner end 848 of the first support spar 834 abuts the outer surface 865 of the inner mount platform 874, while the inner end 848 of the second support spar 836 extends through the inner mount platform 874. The locking pin 879 extends through the inner mount platform 874 and into the surface 855 of the first support spar 834, blocking rotation of the inner vane support 816 relative to the outer vane support 814. The inner end 848 of the second support spar 836 extends through a hole 884 formed in the inner mount platform 874.

In the illustrative embodiment, the second mating feature 878 includes a plurality of bayonet notches 878 as shown in FIGS. 19 and 20. The notches 878 are formed in the inner mount platform 874 and are configured to receive corresponding locating tabs 860 formed on the inner end 848 of the second support spar 836 to provide a bayonet fitting 889 therebetween. The bayonet fitting 889 blocks radial movement of the outer vane support 814 relative to the inner vane support 816. The bayonet notches 878 extend into the inner mount platform 874 around the edges of the hole 884 in the illustrative embodiment.

In some embodiments, the second mating feature 878 may include a single notch 878 that receives a single locking tab 860. In other embodiments, the second mating feature 878 may include a different number of notches 878 with the same number of locking tabs 860.

In the illustrative embodiment, the notches 878 extend into the inner mount platform 874 so that the locking tabs 860 extend into the inner mount platform 874. In other words, the notches 878 extend partway into the outer surface 865 so that the locking tabs 860 are engage a surface located radially between the outer surface 865 and the inner surface 863.

In other embodiments, the notches 878 extend through both surfaces 865, 863 of the inner mount platform 874. In such embodiments, the inner end of the second support spar 836 extends through the inner mount platform 874 so that the bayonet notches 878 are exposed and open radially inward as shown. The locking tabs 860 may then engage an inner surface 863 of the inner mount platform 874 in the respective bayonet notches 878 to radially retain the outer vane support 814.

Figure 18:
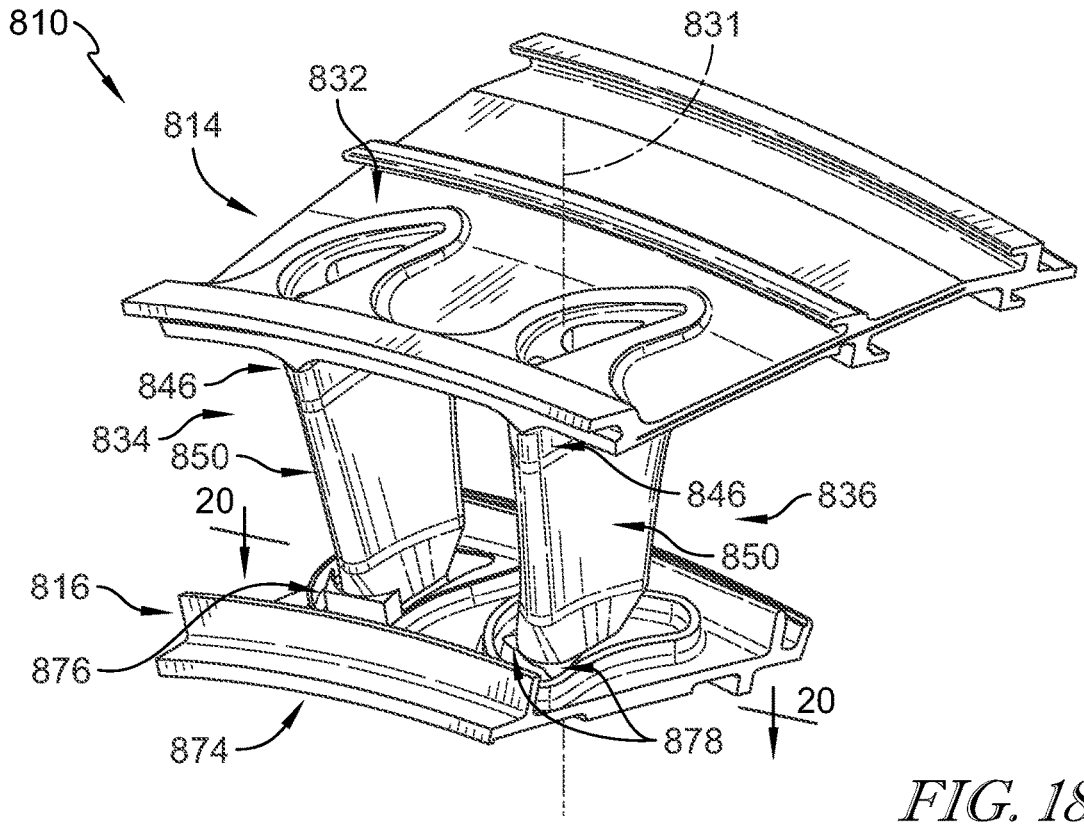
FIG. 18 is a perspective view of another embodiment of a turbine vane assembly showing the turbine vane assembly includes an outer vane support configured to extend radially through turbine vanes to receive force loads from the turbine vanes and an inner vane support configured to be arranged radially inward of the turbine vanes, and further showing the inner vane support is coupled to the outer vane support to locate the turbine vanes radially therebetween.

Turning again to the outer vane support 814, the outer vane support 814 includes an outer mount 832 and the plurality of support spars 834, 836 as shown in FIGS. 18-20. The outer mount 832 extends circumferentially at least partway about the axis 19 and is configured to be coupled to the turbine case 20. Each of the plurality of support spars 834, 836 extends radially inward from the outer mount 832 through one of the plurality of turbine vanes 12. In the illustrative embodiment, the support spars 834, 836 are integrally formed with the outer mount 832.

Each of the support spars 834, 836 include an outer end 846, an inner end 848, and a strut 850 as shown in FIGS. 18 and 19. The outer end 846 is integrally formed with the outer mount 832 in the illustrative embodiment. The inner end 848 is spaced radially inward from the outer end 846 relative to the axis 19 and coupled to the inner vane support 16. The strut 850 extends between and interconnects the outer end 846 and the inner end 848.

The inner end 848 of the first support spar 834 is shaped to include a groove 861 as shown in FIG. 19. The groove 861 extends into an outer surface 859 of the first support spar 834. The groove 861 receives the radial locator 877 of the inner vane support 816 to radially locate the outer vane support 814 relative to the inner vane support 816. The radial locator 877 or groove 861 may plastically deform to lock the first support spar 834 with the inner vane support 816.

The inner end 848 of the second support spar 836 is shaped to include the locking tabs 860 as shown in FIGS. 19 and 20. Each locking tab 860 extends circumferentially from the inner end 848 of the second support spar 836 and into a corresponding notch 878 formed in the inner mount platform 874. The locking tabs 860 each engage with the notches 878 formed in the inner mount platform 874 to provide a bayonet fitting 889 therebetween and radially retain the inner mount platform 874 to the outer vane support 814.

Once the turbine vanes 12 are assembled on the support spars 834, 836, the inner vane support 816 is assembled with the support spars 834, 836 of the outer vane support 814. To assemble the inner vane support 816 with the support spars 834, 836, the inner end 848 of second support spar 836 is inserted into a corresponding hole 884 formed in the inner mount platform 874. As the inner end 848 of the second spar 836 is inserted into the hole 884, the locking tabs 860 are aligned with the corresponding notches 878 in the inner mount platform 874.

A method of assembling the turbine vane assembly 10 may include several steps. Once the inner end 848 is inserted through the hole 884 so that the locking tabs 860 extend into the corresponding notches 878, the outer vane support 814 is rotated about a spar axis 831 of the second support spar 836. The outer vane support 814 is rotated until the rotational stop 876 engages the strut 850 of the first support spar 834 and the locking tabs 860 engage the inner surface 863 of the inner mount platform 874.

The locking tabs 860 engage with the inner mount platform 874 to form the bayonet fitting and block radial movement, while the rotational stop 876 engages the strut 850 of the first support spar 834 to block circumferential movement. In the illustrative embodiment, the rotational stop 876 engages a leading edge of the strut 850.

Figure 22:
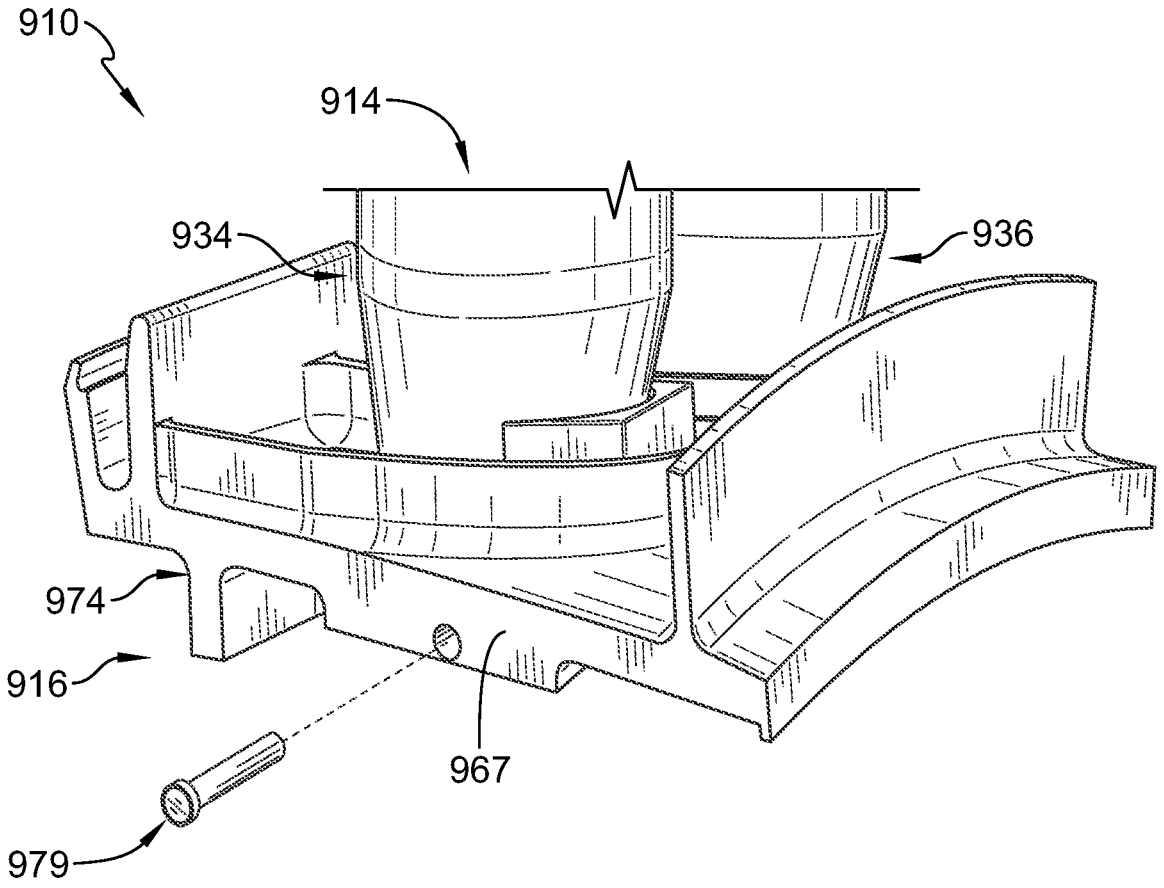
FIG. 22 is an exploded view of another embodiment of a turbine vane assembly showing the turbine vane assembly includes an outer vane support configured to extend radially through turbine vanes to receive force loads from the turbine vanes and an inner vane support configured to be arranged radially inward of the turbine vanes, and further showing the inner vane support includes an inner mount platform coupled to inner ends of the support spars and a locking pin that extends circumferentially through the inner mount platform and into the first support spar to block rotation of the inner vane support relative to the outer vane support.
Figure 23:
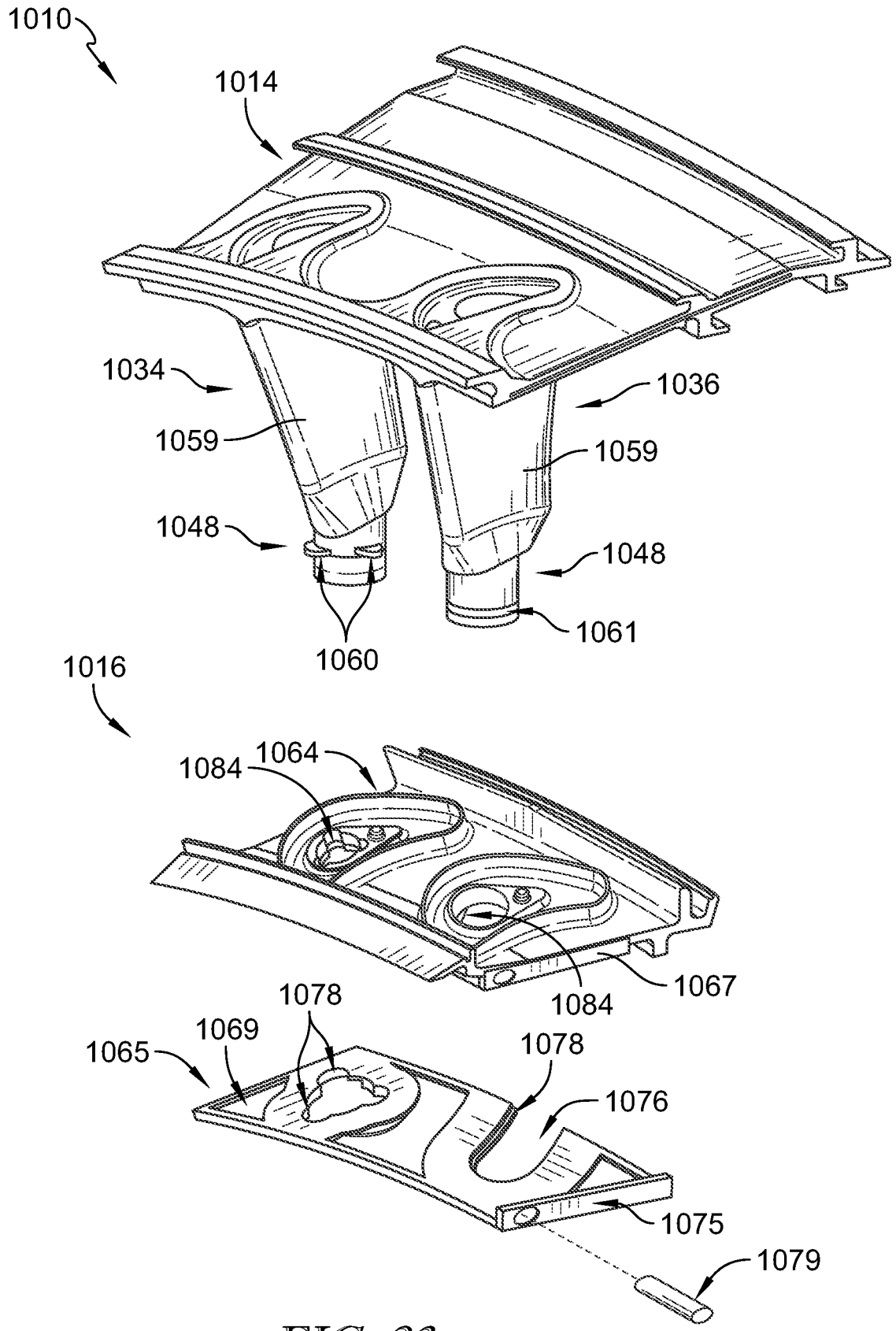
FIG. 23 is an exploded view of another embodiment of a turbine vane assembly showing the turbine vane assembly includes an outer vane support configured to extend radially through turbine vanes to receive force loads from the turbine vanes and an inner vane support configured to be arranged radially inward of the turbine vanes, and further showing the inner vane support includes an inner mount and a retainer plate that mates with inner ends of the outer vane support to provide a bayonet fitting that radially locates the inner mount relative to the outer vane support.

Another embodiment of a turbine vane assembly 910 in accordance with the present disclosure is shown in FIGS. 22 and 23. The turbine vane assembly 910 is substantially similar to the turbine vane assembly 810 shown in FIGS. 18-21 and described herein. Accordingly, similar reference numbers in the 900 series indicate features that are common between the turbine vane assembly 810 and the turbine vane assembly 910. The description of the turbine vane assembly 810 is incorporated by reference to apply to the turbine vane assembly 910, except in instances when it conflicts with the specific description and the drawings of the turbine vane assembly 910.

The turbine vane assembly 910 includes an outer vane support 914 and an inner vane support 916 as shown in FIGS. 22 and 23. The outer vane support 914 is configured to be located radially outward of the turbine vanes 12 and is configured to receive force loads applied to the vanes 12 by the hot gases. The inner vane support 916 is configured to be coupled with the outer vane support 914 to provide a mechanical linkage between the plurality of turbine vanes 12 and reduce twisting of the turbine vane assembly 910 relative to adjacent turbine vane assemblies 910 during use of the turbine vane assembly 910 in the gas turbine engine 110.

In the illustrative embodiments, the inner vane support 916 includes an inner mount platform 974 that extends at least partway circumferentially about the axis and mating features (not shown) that mate with support spars 934, 936 included in the outer vane support 914 to radially locate the inner mount platform 974 relative to the outer vane support 914 and block rotation of the supports 914, 916 relative to each other.

In the illustrative embodiments, the inner vane support 916 further includes a locking pin 979 as shown in FIG. 22. The locking pin 979 extends circumferentially through the inner mount platform 974 and into the first support spar 934 to block rotation of the inner vane support 916 relative to the outer vane support 914.

The locking pin 979 extends into a circumferential side surface 967 of the inner mount platform 974 as shown in FIG. 22. In this way, when the turbine vane assemblies 910 are installed in the engine 10 as a ring structure, the adjacent turbine vane assembly 910 prevents the locking pin 979 from disengaging. In some embodiments, the locking pin 979 may be threaded fastener.

The locking pin 979 is illustrated as a headed pin that may be installed with an interference fit on the head. In other embodiments, the locking pin 979 may be a larger pin. Alternatively, the interference fit may be on the length of the locking pin 979.

Figure 24:
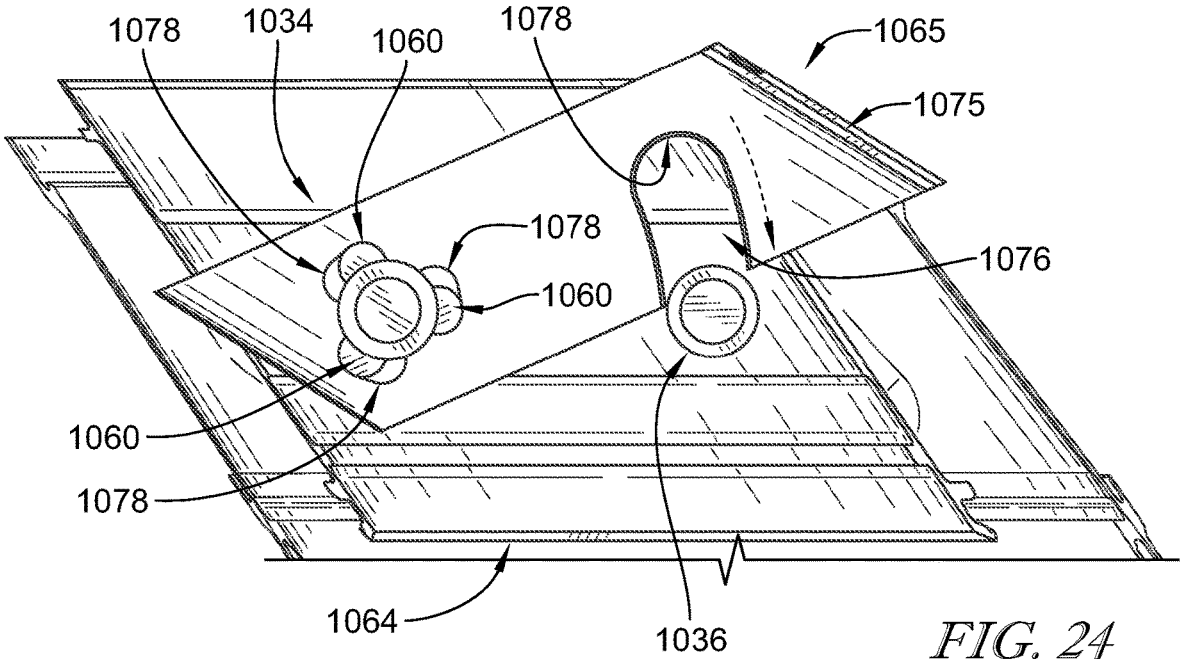
FIG. 24 is a bottom view of the turbine vane assembly of FIG. 23 showing the retainer plate arranged on the inner ends of one support spar so that locking tabs formed on an inner end of one support spar are located in corresponding bayonet notches formed in the retainer plate before the bayonetting fitting is engaged.
Figure 25:
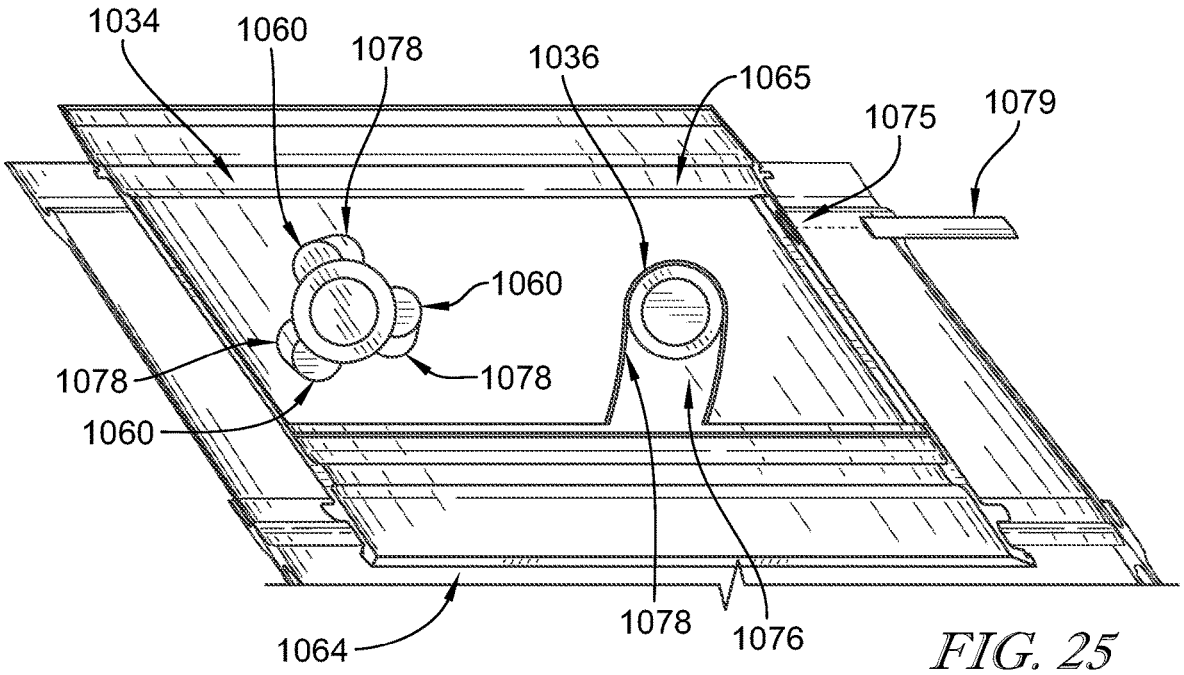
FIG. 25 is a section view similar to FIG. 24 showing the retainer plate rotated so that the locking tabs engage the retainer plate in the bayonet notches, and further showing the other support spar sliding into a slot formed in the retainer plate which allows the retainer plate to be assembled on the inner ends of the support spars.

Another embodiment of a turbine vane assembly 1010 in accordance with the present disclosure is shown in FIG. 24-26. The turbine vane assembly 1010 is substantially similar to the turbine vane assembly 810 shown in FIGS. 18-21 and described herein. Accordingly, similar reference numbers in the 1000 series indicate features that are common between the turbine vane assembly 810 and the turbine vane assembly 1010. The description of the turbine vane assembly 810 is incorporated by reference to apply to the turbine vane assembly 1010, except in instances when it conflicts with the specific description and the drawings of the turbine vane assembly 1010.

The turbine vane assembly 1010 includes an outer vane support 1014 and an inner vane support 1016 as shown in FIGS. 24-26. In the illustrative embodiments, the inner vane support 1016 includes an inner mount 1064 that extends at least partway circumferentially about the axis and a retainer plate 1065 that mates with inner ends 1048 of the outer vane support 1014. The retainer plate 1065 includes mating features 1076, 1078 that mate with support spars 1034, 1036 included in the outer vane support 1014 to radially locate the inner mount 1064 relative to the outer vane support 1014 and block rotation of the supports 1014, 1016 relative to each other.

In the illustrative embodiments, the retainer plate 1065 includes a first mating feature 1076, 1077, the second mating feature 1078, and a locking pin 1079 as shown in FIGS. 24-26. The retainer plate 1065 is configured to be arranged radially inward of the inner mount 1064. The first mating feature 1076, 1077 include a slot 1076 that allows the retainer plate 1065 to be assembled on the inner ends 1048 of the support spars 1034, 1036 and a radial locator 1077 extends around the edge of the slot 1076. The radial locator 1077 engages the first support spar 1034 in a groove 1061 formed in the inner end 1048 to radially locate the outer vane support 1014. The second mating feature 1078 couples with locking tabs 1060 on the inner end 1048 of the second support spar 1036 to block radial movement of the metallic outer vane support 1014 relative to the metallic inner vane support 1016.

In the illustrative embodiment, the retainer plate 1065 includes an endwall 1075 as shown in FIGS. 23-25. The endwall 1075 engages a circumferential side surface 1067 to circumferentially locate the retainer plate 1065. In the illustrative embodiment, the locking pin 1079 extends circumferentially through the endwall 1075 into the inner mount 1064 to lock the retainer plate 1065 to the inner mount 1064. The endwall 1075 is configured so as not to interfere with strip seal slots in the inner vane support 1016.

The inner end 1048 of the first support spar 1034 is shaped to include a groove 1061 as shown in FIG. 24. The groove 1061 extends into an outer surface 1059 of the first support spar 1034. The groove 1061 receives the radial locator 1077 of the retainer plate 1065 to radially locate the outer vane support 1014 relative to the inner vane support 1016. The radial locator 1079 or groove 1061 may plastically deform to lock the first support spar 1034 with the inner vane support 1016.

The inner end 1048 of the second support spar 1036 is shaped to include the locking tabs 1060 as shown in FIGS. 24-26. Each locking tab 1060 extends circumferentially from the inner end 1048 of the second support spar 1036 and into a corresponding notch 1078 formed in the retainer plate 1065. The locking tabs 1060 each engage with the notches 1078 to provide a bayonet fitting 1089 therebetween and radially retain the inner vane support 1016 to the outer vane support 1014.

In some embodiments, the groove 1061 and/or the locking tabs 1060 may be discrete features fabricated in or onto the support spars 1034, 1036 before assembly with the inner vane support 1016. In other embodiments, the inner ends 1048 of the support spars 1034, 1036 may be inserted through the inner mount 1064 and the features 1060, 1061 on the spars 1034, 1036 may be fabricated after assembly. Fabricated the features after assembly may allow for easy repair or reuse of the outer vane support 1014.

Once the turbine vanes 12 are assembled on the support spars 1034, 1036, the inner vane support 1016 is assembled with the support spars 1034, 1036 of the outer vane support 1014. To assemble the inner vane support 1016 with the support spars 1034, 1036, the inner end 1048 of second support spar 1036 is inserted into a corresponding hole 1084 formed in the inner mount 1064. As the inner end 1048 of the second spar 1036 is inserted into the hole 1084, the locking tabs 1060 are aligned with the corresponding notches 1078 in the inner mount 1064.

Once the inner end 1048 is inserted through the hole 1084 so that the locking tabs 1060 extend into the corresponding notches 1078, the outer vane support 1014 is rotated about a spar axis 1031 of the second support spar 1036. The outer vane support 1014 is rotated until the rotational stop 1076 engages the strut 1050 of the first support spar 1034 and the locking tabs 1060 engage the inner surface 1063 of the inner mount 1064.

The locking tabs 1060 engage with the inner mount 1064 to form the bayonet fitting and block radial movement, while the rotational stop 1076 engages the strut 1050 of the first support spar 1034 to block circumferential movement. In the illustrative embodiment, the rotational stop 1076 engages a leading edge of the strut 1050.

The present disclosure relates to reducing the rotation of ceramic matrix composite airfoils and metallic support structures by mechanically linking adjacent structures. The reduction in rotation may be leveraged to reduce the secondary air system leakages and improve engine performance.

In some embodiments, a spar may be used to support a turbine vane and inner stage seal. The differing pressures in the cavities on either side of the inner stage seal may result in an axial load on the spar. Additionally, the force loads applied to the vanes 12 by the hot gases in the gas path 18 may result in an axial component in addition to a circumferential component on the spar also. The present disclosure teaches a turbine vane assembly 10 for minimizing the deflections under these loads, in an effort to maximise sealing performance.

In the illustrative embodiments, the turbine vane assembly 10, 210, 310, 410, 510, 610, 710, 810, 910, 1010 includes discrete load transfer features between the support spars 34, 36, 234, 236, 334, 336, 434, 436, 534, 536, 538, 634, 635, 636, 638, 734, 735, 736, 738, 834, 836, 934, 936, 1034, 1036 and the turbine vanes 12, 412. In some embodiments, the support spars 34, 36, 234, 236, 334, 336, 434, 436, 534, 536, 538, 634, 635, 636, 638, 734, 735, 736, 738, 834, 836, 934, 936, 1034, 1036 may include discrete load transfer features that engage the turbine vane 12, 412 radially inward and/or outerward of the gas path 18.

In some embodiments, to assemble a turbine vane assembly within a gas turbine engine 110, the turbine vane assembly may be fabricated individually then introduced radially to the inner stage seal for fastener to the inner stage seal bird-mouth. Rotation of the turbine vane assembly may be used to properly engage seals. Once the turbine vane assembly is coupled to the inner stage seal, the sub-assembly is lowered into the turbine case 20 and restraint features e.g. hooks into the casing 20 are engaged.

In the illustrative embodiment, the outer mount platform 40 is coupled to the turbine case 20 with a plurality of rails that extend into corresponding features in the case 20. In other embodiments, the outer mount platform 40 may be shaped to include a plurality of hooks that couple the outer mount platform 40 to the case 20. The use of hooks may avoid introducing bending at interface between the outer mount platform 40 and the hook.

In some embodiments, the inner vane support 16 may be segmented resulting in a non-trivial rotation of the assembly. This could induce relative movement and challenge seal clearances. The present disclosure teaches a turbine vane assembly 10 that introduces a mechanical linkage to reduce to rotation of the structure 10, effectively creating a torsion box.

The mechanical linkage is formed by the outer vane support 14 and the inner vane support 16. The inner mount 64 of the inner vane support 16 may span the same number of turbine vanes 12 as the outer mount 32 of the outer vane support structure 14 as shown in FIGS. 2, 12, and 15. In other embodiments, the inner mount 64 of the inner vane support 16 may be split and may link a sub-set of turbine vanes 12 as shown in FIG. 16. Alternatively, the inner mount 64 of the inner vane support 16 may extend to and interconnect adjacent outer vane support structures 14 as shown in FIG. 17.

The arrangement of the mechanical linkage may be a balance of change in stiffness and/or deflection as a function of increasing span of turbine vanes 12. The mechanical linkage arrangement may also be a balance of part count in the gas turbine engine 110, the number of gaps between adjacent turbine vane assemblies 10, and the number of seals and amount of leakage between the assemblies 10.

The mechanical linkage arrangement may also be a balance of mechanical stresses as a result of unequal load sharing and relative movements. The arrangement of the mechanical linkage between the outer vane support 14 and the inner vane support 16 may be a balance of thermal stresses as a result of circumferential temperature gradients. In other embodiment, the mechanical linkage arrangement may also be a balance of the redundancy.

The mechanical linkage between the outer vane support 14 and the inner vane support 16 may be fastened or coupled with a range of embodiments. In some embodiments, the inner vane support 16 may be bolted to the outer vane support 14. In other embodiments, the inner vane support 16 and the outer vane support may be clamped together.

In other embodiments, the outer vane support 14 may be, interference fit with the inner vane support 16. In other embodiments, the inner vane support 16 and the outer vane support 14 may be bi-cast, welded, etc. No matter the fastener arrangement between the outer vane support 14 and the inner vane support 16, the fastener arrangement may minimize compliance (increased deflection) while easily permitting assembly/dis-assembly, introducing acceptable stresses and minimising part count/complexity.

In the illustrative embodiments, the inner vane support 16 includes a hollow passage and/or nozzle arrangement to direct cooling flow. In other embodiments, the inner vane support 16 does not include a passage or nozzle to permit a flow of cooling air. In embodiments, without the nozzles, the flow of cooling air may be transmitted from somewhere else in the gas turbine engine 110 to the cavity 56.

The wedge face of the inner mount 464 may be an axial segmentation as shown in FIG. 12, but alternatively could align with the ceramic vane 12 wedge angle. In other embodiments, the wedge face of the inner mount 64 may align oppose the ceramic vane 12 wedge angle.

In the illustrative embodiments, of FIGS. 18-20, the support spars 834, 836 may be used to simply support a ceramic matrix composite turbine vane 12 (rather than cantilever) and/or transfer loads from an inter-stage seals (ISS). The doublet spar structure 814 reduces deflections and improves sealing performance by increasing the stiffness, forming a torsion box.

In some embodiments, plastic deformation may be induced at spar assembly i.e. bending/distorting the two support spars. To avoid this distortion of the support spars, the radial and circumferential locations may be controlled independently i.e. radial on one spar, circumferential on the other.

In the illustrative embodiments, a bayonet fitting may be applied to one of the support spars 836 as shown in FIG. 19. Upon engagement of the inner end 848 of the support spar 836 with the inner mount platform 874, the inner vane support 816 may not be released radially.

In some embodiments, the turbine vane assembly 810 may include a cam feature. The cam feature may be configured to plastically deform and 'lock' the outer vane support 814 with the inner vane support 816. The other spar 834 will rotate and engage a rotational stop 876, which permits load transfer from inner vane support 816 to the first support spar 834.

In some embodiments, the turbine vane assembly 810 may include an engagement, or radial slot 861, with a shape that encourages plastic deformation e.g. angled slot to 'lock' the structure together. The bayonet fitting 889 may also reduced the part count and minimize the number of small parts that may likely fall into disc cavity if they become disengaged.

The mating features 876, 877, 878 also provide a fail-safe in that the load applied increases the engagement of the features. The redundant features may also provide added safety as more than one feature would need to fail for radial position of the inner mount platform 874 to be lost e.g. the bayonet fitting 889 on its own retains the inner mount platform 874 and permits load transfer.

To avoid constraining the ceramic vanes 12 to interface at the inner mount 1064, the functionality may be split between the inner mount 1064 and retainer plate 1065 whereby, the assembly of the turbine vane assembly 1010 may including (i) positioning the ceramic turbine vanes 12 and any seals onto spar structure 1014, (ii) loading the spar structure 1014 into assembly fixture to accurately position parts, (iii) dropping the inner mount 1064 on-top of spar structure 1014, (iv) installing the retainer plate 1065 on spar so that the locking tabs 1060 align with the bayonet notches 1078, and (v) rotating the retainer plate 1065 until the radial locator 1077 extends into the groove 1061.

The bayonet fitting may include a cam type feature that would plastically deform and 'lock' the structure together. In some embodiments, the radial locator 877 is the cam feature. In other embodiments, the surfaces of the notches 878, 1078 are angles to increase engagement with the locking tabs 860, 1060 and deform the locking tabs 860, 1060 to lock the structure together.

The other spar engages radially locates the assembly. Plastic deformation at interface may also 'lock' the structure together.

Clamping the inner mount 1064 radially between the support spars 1034, 1036 and the retainer plate 1065 allows the structure to transmit axial load through the spar interface and is anti-rotated through the pair of spars. To radially clamp the inner mount 1064, ramped radial clamp surfaces may be included in the notches 1078 to increase engagement on rotation of the retainer plate 1065. The locking tabs 1060 may be shaped to plastically deform and prevent relative movement between the retainer plate 1065 and the support spar 1034. In some embodiments, a ramped radial protrusion may extend radially outward from the retainer plate 1065 that plastically deforms against the inner mount 1064 to lock the components together. Furthermore, grooves may be added to prevent relative axial/circumferential movement if necessary.

In some embodiments, the inner mount 1064 may be pre-loaded on the chordal seals. This may be applied by applying a load between the retainer plate 1065 (radially located onto the spar) and the inner mount 1064 (able to slide radially). This feature my be configured to act like an inverted chordal clamp seal and may eliminate the need for a outer mounted sprung seal.

In other embodiments, springs (not shown) may be located in pockets 1069 of the retainer plate 1065 so engage the inner mount 1064 at the interference therebetween. Corresponding pockets (not shown) may be located in the inner mount 1064 to prevent the springs from escaping the assembly 1010. The height of the pockets may be greater than the expected relative thermal expansion mismatch to ensure that the spring engages on both sets of radial walls. Although the walls are illustrated as a simple pocket 1069, they may be aligned with the spar assembly vector to ensure even loading on the inner mount 1064. A large range of high temperature and creep resistant spring are conceivable.

Further retention features such as internal spigots may be added to locate and trap the springs. For example, a pin attached to the retainer plate 1065 may support a stack of belleville washers while the pin may be engaged in a blind hole in the inner mount 1064 that never disengages with thermal expansion. Alternatively, a wave spring may be located with an outer wall.

Advantageously, when the engine heats up, due to the relative thermal growths a gap would form between turbine vane 12 and inner mount 1064, which means that the stress on a spring feature pre-loading the inner mount 1064 into the spars 1034, 1036 may reduce with temperature, this is beneficial to the springs creep capability. In some embodiments, multiple springs may be introduced as a means of reducing the stress in each part and provide redundancy.

While the disclosure has been illustrated and described in detail in the foregoing drawings and description, the same is to be considered as exemplary and not restrictive in character, it being understood that only illustrative embodiments thereof have been shown and described and that all changes and modifications that come within the spirit of the disclosure are desired to be protected.

What is claimed is:

1. A turbine vane assembly for use in a gas turbine engine comprises a plurality of ceramic matrix composite turbine vanes adapted to interact with hot gases flowing through a gas path of the gas turbine engine during use of the turbine vane assembly, the plurality of ceramic matrix composite turbine vanes including a first turbine vane and a second turbine vane spaced apart circumferentially from the first turbine vane relative to an axis, a metallic outer vane support configured to receive force loads applied to the plurality of ceramic matrix composite turbine vanes by the hot gases during use of the turbine vane assembly in the gas turbine engine, the metallic outer vane support including an outer mount located radially outward of the plurality of ceramic matrix composite turbine vanes and extending at least partway circumferentially about the axis, a first support spar that extends radially inward from the outer mount through an interior cavity of the first turbine vane, and a second support spar spaced apart circumferentially from the first support spar relative to the axis that extends radially inward from the outer mount through an interior cavity of the second turbine vane, wherein the first and second support spars are integrally formed with the outer mount to form a single-piece component, and a metallic inner vane support spaced apart radially from the outer mount relative to the axis to locate the plurality of ceramic matrix composite turbine vanes radially between, the metallic inner vane support including an inner mount that extends at least partway circumferentially about the axis and at least two fasteners configured to couple the first and second support spars of the metallic outer vane support to the inner mount to provide a mechanical linkage between the first turbine vane and the second turbine vane and reduce twisting of the turbine vane assembly and adjacent turbine vane assemblies relative to one another during use of the turbine vane assembly in the gas turbine engine, wherein the inner mount includes an inner mount platform that extends at least circumferentially partway about the axis between the plurality of ceramic matrix composite turbine vanes and raised interface surfaces spaced circumferentially apart from one another that each extend radially outward from the inner mount platform and engage one of the first support spar and the second support spar to block radial movement of the inner mount relative to the metallic outer vane support, and wherein the inner mount further includes anti-rotation pegs that each extend radially outward from one of the raised interface surfaces and into a corresponding support spar to block twisting of the inner mount relative to the metallic outer vane support.

2. The turbine vane assembly of claim 1, wherein the metallic inner vane support further includes a first nozzle arranged radially inward from the inner mount platform and configured to receive an inner end of the first support spar and a second nozzle arranged radially inward from the inner mount platform and configured to receive an inner end of the second support spar.

3. The turbine vane assembly of claim 2, wherein the inner end of each of the first and second support spars is threaded and the at least two fasteners are nuts configured to mate with threads on the inner end of one of the first and second support spars and engage one of the first nozzle and the second nozzle to maintain engagement of the raised interface surfaces and the anti-rotation pegs with the corresponding support spar of the first support spar and the second support spar.

4. The turbine vane assembly of claim 2, wherein the inner mount, the first nozzle, and the second nozzle of the metallic inner vane support are integrally formed such that the inner mount, the first nozzle, and the second nozzle are a one-piece, integral component.

5. The turbine vane assembly of claim 2, wherein the first nozzle and the second nozzle each include a cylindrical tube configured to receive the inner end of one of the first support spar and the second support spar, an anti-rotation notch that extends into the cylindrical tube and is configured to receive an anti-rotation tab extending radially inward from the inner mount platform, and a spout that extends circumferentially from the cylindrical tube and is configured to discharge a flow of cooling air.

6. The turbine vane assembly of claim 2, wherein the inner end of each of the first and second support spars is threaded and the at least two fasteners each include a first nut configured to mate with threads on the inner end of one of the first and second support spars and engage the inner mount platform to maintain engagement of the raised interface surfaces and the anti-rotation pegs with the corresponding support spar of the first support spar and the second support spar and a second nut spaced radially inward of the first nut to locate one of the first nozzle and the second nozzle therebetween and configured to mate threads on the inner end of one of the first support spar and the second support spar and engage one of the first nozzle and the second nozzle to block removal of the one of the first nozzle and the second nozzle off the inner end of the one of the first support spar and the second support spar.

7. The turbine vane assembly of claim 1, wherein the metallic outer vane support includes an outer mount platform that extends circumferentially at least partway about the axis and is configured to be coupled to a turbine case of the gas turbine engine and a plurality of reinforcement extensions that extend radially outward from an outer surface of the outer mount platform relative to the axis and are configured to minimize resulting stresses in the outer mount platform due to the twisting of the turbine vane assembly.

8. The turbine vane assembly of claim 7, wherein the plurality of reinforcement extensions include a plurality of axially extending reinforcement ribs that extend radially outward from and axially along the outer surface of the outer mount platform relative to the axis and a plurality of circumferentially extending reinforcement ribs that extend radially outward from and circumferentially along the outer surface of the outer mount platform relative to the axis.

9. A turbine vane assembly for use in a gas turbine engine comprises a plurality of ceramic matrix composite turbine vanes adapted to interact with hot gases flowing through a gas path of the gas turbine engine during use of the turbine vane assembly, the plurality of ceramic matrix composite turbine vanes including a first turbine vane and a second turbine vane spaced apart circumferentially from the first turbine vane relative to an axis, a metallic outer vane support configured to receive force loads applied to the plurality of ceramic matrix composite turbine vanes by the hot gases during use of the turbine vane assembly in the gas turbine engine, the metallic outer vane support including an outer mount located radially outward of the plurality of ceramic matrix composite turbine vanes and extending at least partway circumferentially about the axis, a first support spar that extends radially inward from the outer mount through an interior cavity of the first turbine vane, and a second support spar spaced apart circumferentially from the first support spar relative to the axis that extends radially inward from the outer mount through an interior cavity of the second turbine vane, wherein the first and second support spars are integrally formed with the outer mount to form a single-piece component, and a metallic inner vane support spaced apart radially from the outer mount relative to the axis to locate the plurality of ceramic matrix composite turbine vanes radially between, the metallic inner vane support including an inner mount that extends at least partway circumferentially about the axis and at least two fasteners configured to couple the first and second support spars of the metallic outer vane support to the inner mount to provide a mechanical linkage between the first turbine vane and the second turbine vane and reduce twisting of the turbine vane assembly and adjacent turbine vane assemblies relative to one another during use of the turbine vane assembly in the gas turbine engine, wherein the inner mount includes an inner mount platform that extends at least circumferentially partway about the axis between the plurality of ceramic matrix composite turbine vanes and raised interface surfaces spaced circumferentially apart from one another that each extend radially outward from the inner mount platform and engage one of the first support spar and the second support spar to block radial movement of the inner mount relative to the metallic outer vane support, and wherein the metallic inner vane support further includes a first nozzle arranged radially inward from the inner mount platform and configured to receive an inner end of the first support spar, and a second nozzle arranged radially inward from the inner mount platform and configured to receive an inner end of the second support spar, and wherein the at least two fasteners include a plurality of bolts that each extend through one of the first nozzle and the second nozzle and the inner mount platform into one of the first support spar and the second support spar to couple each of the first nozzle and the second nozzle to the inner mount platform and block twisting of the metallic inner vane support relative to the metallic outer vane support.

10. A turbine vane assembly for use in a gas turbine engine comprises a plurality of ceramic matrix composite turbine vanes adapted to interact with hot gases flowing through a gas path of the gas turbine engine during use of the turbine vane assembly, the plurality of ceramic matrix composite turbine vanes including a first turbine vane and a second turbine vane spaced apart circumferentially from the first turbine vane relative to an axis, a metallic outer vane support configured to receive force loads applied to the plurality of ceramic matrix composite turbine vanes by the hot gases during use of the turbine vane assembly in the gas turbine engine, the metallic outer vane support including an outer mount located radially outward of the plurality of ceramic matrix composite turbine vanes and extending at least partway circumferentially about the axis, a first support spar that extends radially inward from the outer mount through an interior cavity of the first turbine vane, and a second support spar spaced apart circumferentially from the first support spar relative to the axis that extends radially inward from the outer mount through an interior cavity of the second turbine vane, wherein the first and second support spars are integrally formed with the outer mount to form a single-piece component, and a metallic inner vane support spaced apart radially from the outer mount relative to the axis to locate the plurality of ceramic matrix composite turbine vanes radially between, the metallic inner vane support including an inner mount platform that extends at least partway circumferentially about the axis, a first mating feature that engages an inner end of the first support spar to block rotation of the metallic outer vane support about a spar axis relative to the metallic inner vane support, and a second mating feature that couples to an inner end of the second support spar to block radial movement of the metallic outer vane support relative to the metallic inner vane support.

11. The turbine vane assembly of claim 10, wherein the metallic inner vane support further includes a locking pin that extends through the inner mount platform and into the first support spar to block circumferential rotation of the metallic outer vane support about the axis relative to the metallic inner vane support.

12. The turbine vane assembly of claim 10, wherein the first mating feature is a rotational stop that extends radially outward from the inner mount platform and engages the inner end of the first support spar to provide load transfer from the inner mount platform to the first support spar of the metallic outer vane support.

13. The turbine vane assembly of claim 10, wherein the second mating feature is at least one locking notch formed in the inner mount platform and the second support spar includes at least one locking tab that extends circumferentially from the inner end of the second support spar and into the notch to provide a bayonet fitting therebetween that block radial movement of the metallic outer vane support relative to the metallic inner vane support.

14. A turbine vane assembly comprising a plurality of turbine vanes, an outer vane support including at least one outer mount located radially outward of the plurality of turbine vanes and extending circumferentially at least partway about an axis and a plurality of support spars that each extend radially inward from the at least one outer mount through an interior cavity of one turbine vane of the plurality of turbine vanes, and an inner vane support spaced apart radially from the at least one outer mount relative to the axis to locate the plurality of turbine vanes radially between, the inner vane support including an inner mount that extends circumferentially at least partway about the axis and a plurality of fasteners each configured to couple a corresponding support spar of the plurality of support spars of the outer vane support to the inner mount, wherein the outer vane support includes at least two outer mounts having a second outer mount spaced apart circumferentially from a first outer mount, wherein the plurality of support spars includes a first support spar that extends radially inward from the first outer mount through a first turbine vane of the plurality of turbine vanes and couples to the inner vane support, a second support spar spaced apart circumferentially from the first support spar relative to the axis that extends radially inward from the first outer mount through a second turbine vane of the plurality of turbine vanes and couples to the inner vane support, a third support spar that extends radially inward from the second outer mount through a third turbine vane of the plurality of turbine vanes and couples to the inner vane support, and a fourth support spar spaced apart circumferentially from the third support spar relative to the axis that extends radially inward from the second outer mount through a fourth turbine vane of the plurality of turbine vanes and couples to the inner vane support, and wherein the first support spar and the second support spar are integrally formed with the first outer mount to form a single-piece component and the third support spar and the fourth support spar are integrally formed with the second outer mount to form a single-piece component.

15. The turbine vane assembly of claim 14, wherein the first outer mount and the second outer mount each include an outer mount platform that extends at least partway about the axis and is configured to be coupled to a turbine case and a plurality of reinforcement extensions that extend radially outward from an outer surface of the outer mount platform relative to the axis.

16. The turbine vane assembly of claim 15, wherein the at least one inner mount includes an inner mount platform that extends at least circumferentially partway about the axis between the plurality of turbine vanes, raised interface surfaces spaced circumferentially apart from one another that each extend radially outward from the inner mount platform and engage one of the plurality of support spars to block radial movement of the at least one inner mount relative to the outer vane support, and anti-rotation pegs that each extend radially outward from one of the raised interface surfaces and into one support spar of the plurality of support spars to block twisting of the at least one inner mount relative to the outer vane support.

* * * * *